US008469616B2

(12) United States Patent
Kawaguchi

(10) Patent No.: US 8,469,616 B2
(45) Date of Patent: Jun. 25, 2013

(54) PRINTER WITH CUTTER

(75) Inventor: Kouji Kawaguchi, Chiba (JP)

(73) Assignee: Seiko Instruments Inc. (JP)

( * ) Notice: Subject to any disclaimer, the term of this patent is extended or adjusted under 35 U.S.C. 154(b) by 787 days.

(21) Appl. No.: 12/592,863

(22) Filed: Dec. 3, 2009

(65) Prior Publication Data

US 2010/0143018 A1 Jun. 10, 2010

(30) Foreign Application Priority Data

Dec. 4, 2008 (JP) ..... 2008-309786

(51) Int. Cl.
*B41J 11/00* (2006.01)
*B41J 11/70* (2006.01)

(52) U.S. Cl.
USPC ..... 400/621; 400/611; 400/693

(58) Field of Classification Search
USPC ..... 400/611, 621, 621.1, 691, 693
See application file for complete search history.

(56) References Cited

U.S. PATENT DOCUMENTS

| | | | | |
|---|---|---|---|---|
| 6,447,187 | B1 | 9/2002 | Robinson | 400/621 |
| 6,848,847 | B2 * | 2/2005 | Murakoshi et al. | 400/621 |
| 6,899,479 | B2 * | 5/2005 | Hayashi et al. | 400/621 |
| 7,267,500 | B2 * | 9/2007 | Tsuchiya et al. | 400/621 |
| 7,281,874 | B2 * | 10/2007 | Watanabe et al. | 400/691 |
| 2002/0056354 | A1 | 5/2002 | Morita et al. | 83/564 |

FOREIGN PATENT DOCUMENTS

| | | | |
|---|---|---|---|
| EP | 1445113 | | 8/2004 |
| EP | 1955833 | | 8/2008 |
| JP | 2003-311676 | * | 4/2002 |
| JP | 2002219832 | | 8/2002 |
| WO | 03064163 | | 8/2003 |

* cited by examiner

*Primary Examiner* — Matthew G Marini
*Assistant Examiner* — Marissa Ferguson Samreth
(74) *Attorney, Agent, or Firm* — Adams & Wilks

(57) ABSTRACT

A printing device has a print head, a platen roller, a main body frame supporting one of the print head and the platen roller, and a main body unit incorporating the main body frame. A sheet cutting device includes a first blade undergoing sliding movement relative to a second blade in a direction substantially orthogonal to a sheet material to be cut. A first frame slidably supports the first blade and undergoes movement in a direction orthogonal to a sliding direction of the first blade from a first position at which the first blade frame is incorporated to the main body frame to a second position at which the first blade frame is separated from the main body frame. A second frame supports the second blade and undergoes movement in the sliding direction of the first blade from a first position at which the second blade frame is mounted to the main body unit to a second position at which the second blade frame is detached from the main body unit. The first and second blades undergo movement in directions orthogonal to each other during movement of the first and second blade frames to the respective second positions to release a contact pressure between the first and second blades.

15 Claims, 16 Drawing Sheets

PRINTER WITH CUTTER

BACKGROUND OF THE INVENTION

1. Field of the Invention

The present invention relates to a printer with a cutter, which can appropriately cut a recording sheet drawn out of a paper roll after printing is performed on the recording sheet.

2. Description of the Related Art

At present, there are provided various kinds of many thermal printers, in which printing is performed by pressing a thermal head against a special recording sheet (heat-sensitive sheet) which changes in color when heat is applied thereto, and by developing color on the recording sheet by heating. In particular, smooth characters and multicolor graphics can be printed without using toner, ink, and the like, and hence the thermal printers are preferably used for printing of various kinds of labels, receipts, and tickets.

As represented by the thermal printers as described above, there are known many printers with a cutter including a cutter mechanism for automatically cutting the printed recording sheet. Generally, the cutter mechanism includes a fixed blade and a movable blade capable of sliding with respect to the fixed blade. Further, when the recording sheet is cut, the movable blade is slid so as to climb onto an upper surface of the fixed blade. With this, the recording sheet can be cut while being sandwiched between cutting edges of the both blades as the recording sheet is cut with a pair of scissors.

Further, as a structure in which the cutter mechanism is incorporated into the thermal printer, there are known an integrated type structure in which a cutter unit including the fixed blade and the movable blade integrated with each other is incorporated to a main body unit, and a clamshell type structure in which a detachable unit is detachably provided to the main body unit, and the fixed blade is incorporated into one of the main body unit and the detachable unit and the movable blade is incorporated into the other one of the main body unit and the detachable unit, and thus the fixed blade and the movable blade can be separated from each other.

As described in JP 2002-144655 A, for example, there is known a clamshell thermal printer including a main body unit having a movable blade, and a detachable unit having a fixed blade, in which both the main body unit and the detachable unit can turn in a direction orthogonal to a sliding direction of the movable blade, and the main body unit moves to a cutting position while pressurizing the detachable unit when the main body unit turns.

Incidentally, in each of the above-mentioned thermal printers, there may arise a problem that the movable blade is stopped during sliding due to such phenomena that foreign matters are caught between the fixed blade and the movable blade, that the recording sheet drawn out of the paper roll is caught (so-called paper jam), that blades bite each other in a process of cutting operation, and that malfunction occurs.

In this case, in the above-mentioned integrated type structure of the cutter mechanism, it is necessary that a releasing knob or the like for manually sliding the movable blade be provided, and that the movable blade be forcibly retreated through manipulating this knob to thereby be restored to a state before the problem arises. Therefore, restoring work for the movable blade is complicated, and there is a problem that a burden is imposed on a user.

Meanwhile, in the above-mentioned clamshell type structure as described in JP 2002-144655 A, when the movable blade is stopped halfway, the movable blade covers the fixed blade from an upper surface side of the fixed blade. Thus, if the main body unit and the detachable unit are intended to be turned, there is a problem that the detachable unit cannot be released due to contact of the fixed blade with the movable blade. Therefore, in order to release the detachable unit, it is necessary that the movable blade be retreated manually in the same manner as that in the case of the integrated type structure.

Further, when the recording sheet is cut, it is necessary that the movable blade be slid while the fixed blade is held in press-contact with the movable blade at a moderate contact pressure. In this case, in the clamshell type structure, in order to perform stable printing and cutting operation, it is necessary to reliably fix the main body unit and the detachable unit to each other while positioning between the main body unit and the detachable unit is performed.

SUMMARY OF THE INVENTION

The present invention has been made in view of the above-mentioned circumstances, and an object of the present invention is therefore to provide a printer with a cutter, which can easily restore, even when there arises a problem that the movable blade is stopped during sliding due to paper jam or the like, the movable blade to the state before the problem arises, reliably perform positioning between the movable blade frame and the detachable unit, and improve printing accuracy and cutting accuracy.

In order to solve the above-mentioned problems in the related art, the present invention provides the following techniques.

According to the present invention, provided is a printer with a cutter for cutting a recording sheet after printing is performed on the recording sheet, the cutter including a fixed blade and a movable blade which are arranged to be opposed to each other while sandwiching a passing surface for the recording sheet, the movable blade sliding toward the fixed blade and being capable of cutting the recording sheet while sandwiching the recording sheet between the fixed blade and the movable blade. The printer with the cutter includes: a movable blade frame for slidably supporting the movable blade; a main body frame for supporting one of a print head and a platen roller; a main body unit configured by incorporating the movable blade frame to the main body frame; and a detachable unit detachably provided to the main body unit, in which the fixed blade is incorporated, and by which another one of the print head and the platen roller is supported, in which: the detachable unit is movable in a sliding direction of the movable blade from a mounted position, at which the detachable unit is mounted to the main body unit, to a dismounted position, at which the detachable unit is detached from the main body unit; and the movable blade frame is movable in a direction orthogonal to the sliding direction of the movable blade from a home position, at which the movable blade frame is incorporated to the main body frame, to a separated position, at which the movable blade frame is separated from the main body frame.

According to this configuration, while the detachable unit moves along the sliding direction of the movable blade, the movable blade frame moves in the direction orthogonal to the sliding direction of the movable blade. Accordingly, the movable blade and the fixed blade retreat in directions orthogonal to each other, respectively. That is, a contact pressure between both blades is promptly released when the detachable unit and the movable blade frame move.

With this configuration, the movable blade and the fixed blade retreat in the directions orthogonal to each other, respectively. Thus, in a case of occurrence of paper jam or the like, even when the movable blade is stopped during sliding and retreating of the both blades is difficult, the movable and fixed blades neither interfere with each other due to contact therebetween nor retreat while catching the recording sheet therebetween at the time of retreating of both blades. As a result, it is possible to easily release the contact pressure between the two blades, and to promptly release the recording sheet caught between the blades. Thereafter, by removing the recording sheet caught between the two blades, it is possible to easily perform restoring work for paper jam. Note that, even when the movable blade is stopped due to intrusion of foreign matters, malfunction, and the like, it is possible to perform restoring work by a similar operation.

Therefore, even when there arises a problem that the movable blade is stopped during sliding due to paper jam or the like, it is possible to easily restore the movable blade to the state before the problem arises. Thus, it is possible to prevent a situation where the open-close door cannot be opened. As a result, it is possible to improve operativity, and to alleviate a burden on a user. Further, unlike the conventional case, it is unnecessary to separately provide a knob or the like for forcibly moving the movable blade, and hence it is possible to reduce manufacturing cost as well.

Further, a printer with the cutter according to the present invention further includes: a rack provided integrally with the movable blade; a drive means provided in the main body frame, for sliding the movable blade; and a gear train mechanism for transmitting a drive force from the drive means to the rack, in which: the gear train mechanism and the rack are meshed with each other at the home position of the movable blade frame; and meshing between the gear train mechanism and the rack is released at the separated position of the movable blade frame.

According to this configuration, by releasing meshing between the gear train mechanism and the rack at the separated position of the movable blade, it is possible to easily restore the movable blade to an initial position, and hence it is possible to promptly perform restoring work for the movable blade. In addition, simultaneously with moving operation of the movable blade frame, it is possible to release meshing between the gear train mechanism and the rack. In this context, it is unnecessary to separately provide a lever or the like for releasing meshing between the gear train mechanism and the rack, and hence it is possible not only to reduce manufacturing cost but also to further improve operativity.

Further, in a printer with the cutter according to the present invention, a biasing means for biasing the movable blade in a direction of separating the movable blade from the fixed blade is provided between the movable blade and the movable blade frame.

According to this configuration, the movable blade is biased in the direction of separating from the fixed blade. Thus, at a point in time (retreat position) when meshing between the rack and the gear train mechanism is released, the movable blade automatically retreats to the initial position. Therefore, through easy manipulation of merely moving the movable blade frame to the retreat position, restoring work for the movable blade can be performed as well, and hence it is possible to improve operativity, and to alleviate a burden on a user.

Further, in a printer with the cutter according to the present invention, a biasing means for biasing the movable blade frame to the separated position is provided between the movable blade frame and the main body frame.

According to this configuration, the movable blade frame is biased toward the separated position, and hence it is possible to automatically move the movable blade frame to the separated position after the movable blade frame is released from the home position. Therefore, it is possible to perform restoring work for the movable blade more easily, and to improve operativity.

Further, in a printer with the cutter according to the present invention, the main body unit is incorporated into a casing having an opening from which the recording sheet is received, and a stopper for preventing the movable blade from protruding from the movable blade frame at the separated position of the movable blade frame is formed in the casing.

According to this configuration, the stopper is formed in the casing, and hence it is possible to prevent the movable blade from protruding from the movable blade frame at the separated position of the movable blade frame.

Further, in a printer with the cutter according to the present invention, the detachable unit includes a lever member capable of turning about a shaft, the lever member including a lock pin protruding in a width direction of the fixed blade, the main body frame includes a first recess for receiving the shaft in a state in which the detachable unit is at the mounted position, and a second recess for receiving the lock pin in the state in which the detachable unit is at the mounted position, a first regulating portion for regulating movement of the shaft in the state in which the detachable unit is at the mounted position is formed at an inner peripheral edge of the first recess, and a second regulating portion for regulating movement of the lock pin in the state in which the detachable unit is at the mounted position is formed at an inner peripheral edge of the second recess, the second regulating portion being formed such that the lock pin is capable of slipping out of the second recess when the lever member turns about the shaft.

According to this configuration, in a state in which the shaft and the lock pin are regulated in the movement by the first regulating portion of the first recess and the second regulating portion of the second recess at the mounted position, respectively, the detachable unit is mounted to the main body frame. With this configuration, it is possible to stably hold the detachable unit to the main body frame. In addition, at the time of detaching of the detachable unit, merely by turning the lever member about the shaft, regulation against the lock pin by the second regulating portion is canceled, and the lock pin slips out of the second recess. With this, locking between the detachable unit and the main body frame is canceled, and thus it is possible to easily detach the detachable unit from the main body frame.

Further, in a printer with the cutter according to the present invention, the movable blade frame includes a third recess to be engaged with the shaft together with the first recess of the main body frame in a state at the home position, and a guide portion for guiding the shaft such that the movable blade frame moves to the home position when the detachable unit moves to the mounted position, and for guiding the shaft such that the detachable unit moves to the dismounted position when the movable blade frame moves to the separated position is formed at an inner peripheral edge of the third recess.

According to this configuration, the shaft provided in the detachable unit is engaged in the third recess of the movable blade frame with the first recess, and hence it is possible to stably hold the detachable unit to the main body frame and the movable blade frame.

In particular, when the movable blade frame is biased toward the separated position, the shaft can be brought to one side in the first recess by the guide portion, and positioning between the detachable unit and the movable blade frame is reliably performed. Thus, it is possible to arrange the movable blade with respect to the fixed blade at an appropriate position. That is, the movable blade can be held in press-contact with the fixed blade at a moderate contact pressure. Thus, it is possible to perform stable cutting operation by the both blades, and to improve cutting accuracy.

Further, in a printer with the cutter according to the present invention, a biasing means for biasing the movable blade frame to the home position is provided between the movable blade frame and the main body frame.

According to this configuration, the movable blade frame is biased toward the home position. Thus, when the movable blade frame is at the home position, it is possible to stably hold the movable blade frame with respect to the main body frame without backlash.

Further, in a printer with the cutter according to the present invention, the detachable unit includes an engagement pin protruding in a width direction of the fixed blade, the main body frame includes a recess for receiving the engagement pin in a state in which the detachable unit is at the mounted position, and the movable blade frame includes a hook portion to be engaged in the recess with the engagement pin in a state at the home position.

According to this configuration, the engagement pin provided in the detachable unit is engaged with the recess and the hook portion while being sandwiched therebetween. Thus, after positioning the detachable unit with respect to the main body frame and the movable blade frame reliably, it is possible to stably hold the detachable unit to the main body frame and the movable blade frame. That is, the movable blade can be held in press-contact with the fixed blade at the moderate contact pressure. Thus, it is possible to perform stable cutting operation by the both blades, and to improve printing accuracy and cutting accuracy.

Further, in a printer with the cutter according to the present invention, a paper powder accumulating portion for collecting paper powder generated when the recording sheet is cut is provided between the movable blade frame and the main body frame.

According to this configuration, the paper powder accumulating portion is provided between the main body frame and the movable blade frame. Thus, the paper powder, which is generated when the recording sheet is cut, falls downward due to impact or the like at the time of cutting operation and moving of the movable blade frame between the home position and the separated position, to thereby be received in the paper powder accumulating portion. Therefore, the paper powder does not accumulate between the movable blade frame and the main body frame, and hence it is possible to improve ease of maintenance. As a result, there is no fear that sliding operation or the like for the movable blade is inhibited, and there is no fear that the paper powder adheres to the movable blade and cutting accuracy in the recording sheet is decreased. Therefore, it is possible to perform stable cutting operation by the both blades.

Further, in a printer with the cutter according to the present invention, an introducing portion formed to protrude from an end portion in a width direction of the movable blade climbs onto the fixed blade when the movable blade frame moves to the home position.

According to this configuration, in the state at the home position, the introducing portion of the movable blade is arranged so as to climb onto the fixed blade. As a result, the movable and fixed blades are held in contact with each other at the moderate contact pressure without forming a bend for guiding in the introducing portion as in the conventional case. Therefore, it is possible to reduce manufacturing cost for forming the bend.

In the printer with the cutter according to the present invention, while the detachable unit moves along the sliding direction of the movable blade, the movable blade frame moves in the direction orthogonal to the sliding direction of the movable blade. Accordingly, the movable blade and the fixed blade retreat in the directions orthogonal to each other, respectively. That is, the contact pressure between both blades is released when the detachable unit and the movable blade frame move.

With this configuration, the movable blade and the fixed blade retreat in the directions orthogonal to each other, respectively. Thus, in the case of occurrence of paper jam or the like, even when the movable blade is stopped during sliding and retreating of both blades is difficult, the blades neither interfere with each other due to contact therebetween nor retreat while catching the recording sheet therebetween at the time of retreating of the both blades. As a result, it is possible to easily release the contact pressure between the two blades, and to promptly release the recording sheet caught between the blades. Thereafter, by removing the recording sheet caught between the two blades, it is possible to easily perform restoring work for paper jam. Note that, even when the movable blade is stopped due to intrusion of foreign matters, malfunction, and the like, it is possible to perform restoring work by the similar operation.

Therefore, even when there arises the problem that the movable blade is stopped during sliding due to paper jam or the like, it is possible to easily restore the movable blade to the state before the problem arises. Thus, it is possible to prevent the situation where the open-close door cannot be opened. As a result, it is possible to improve operativity, and to alleviate a burden on a user. Further, unlike the conventional case, it is unnecessary to separately provide the knob or the like for forcibly moving the movable blade, and hence it is possible to reduce manufacturing cost as well.

DETAILED DESCRIPTION OF THE PREFERRED EMBODIMENTS (First Embodiment)

(Thermal Printer)

Figure 1:
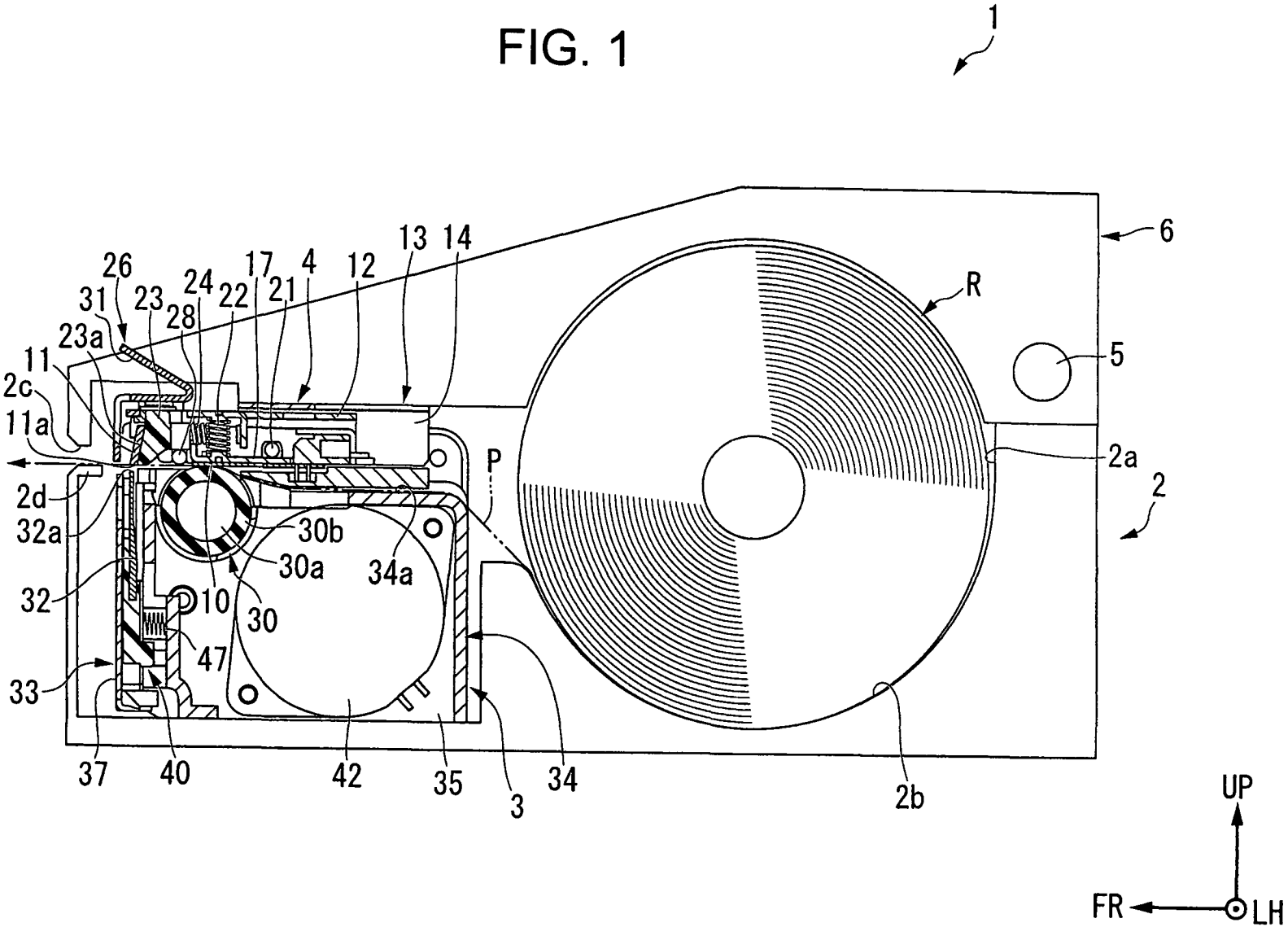
FIG. 1 is a sectional view of a thermal printer according to each of embodiments of the present invention, illustrating a state in which an open-close door is closed.
Figure 2:
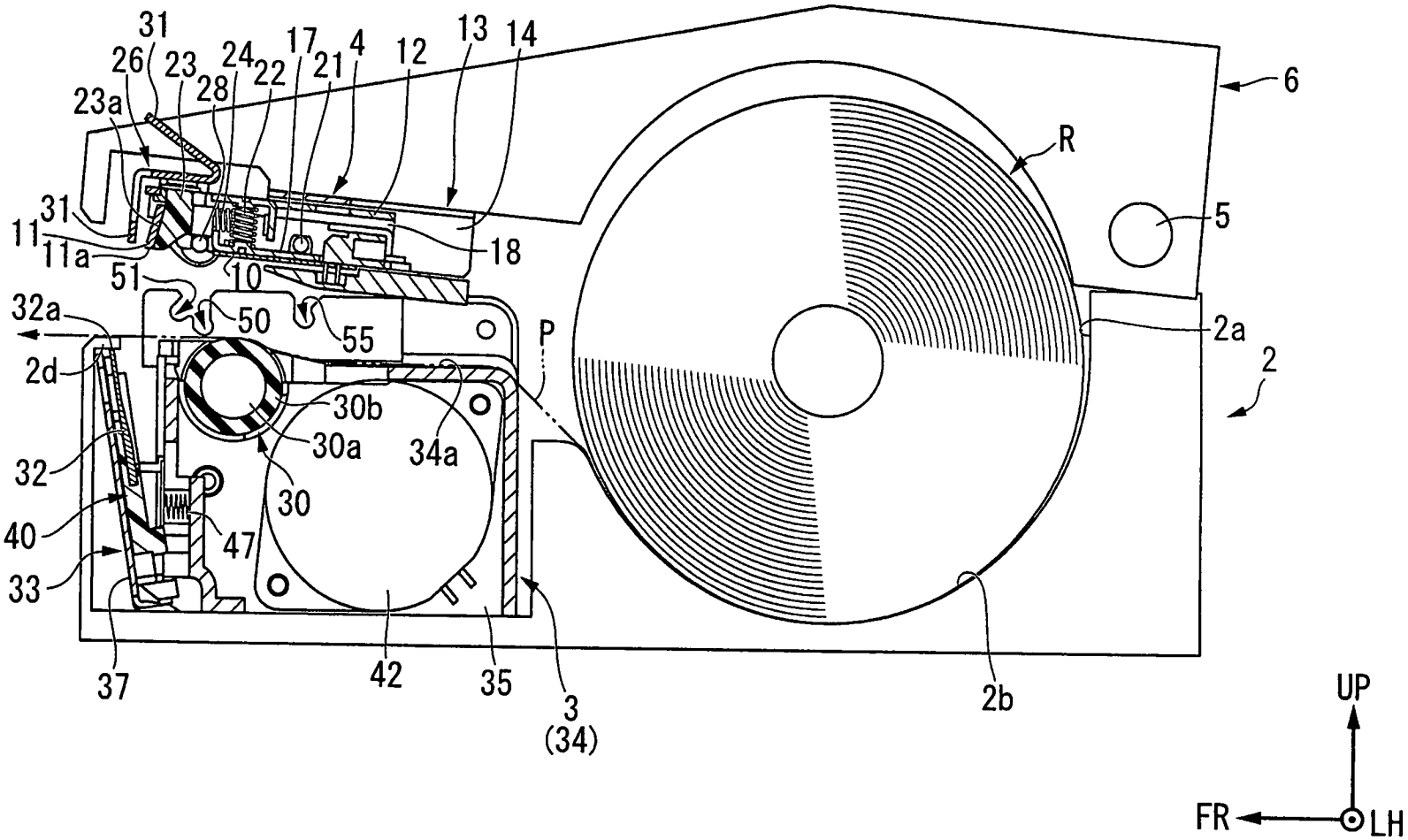
FIG. 2 is a sectional view of the thermal printer according to each of the embodiments of the present invention, illustrating a state in which the open-close door is opened.

Next, an embodiment of the present invention is described with reference to the drawings. Note that, in this embodiment, a thermal printer is described as an example of a printer with a cutter. FIGS. 1 and 2 are sectional views of the thermal printer. FIG. 1 illustrates a state in which an open-close door is closed, and FIG. 2 illustrates a state in which the open-close door is opened. Note that, in the following description, symbols FR, LH, and UP indicate front, left, and upper sides, respectively.

As illustrated in FIGS. 1 and 2, a thermal printer 1 is a so-called clamshell printer in which printing is performed on a sheet material or recording sheet P drawn out of a paper roll R, and then this recording sheet P is appropriately cut to thereby be used as a ticket, receipt, or the like. That is, the thermal printer 1 mainly includes a casing 2, an open-close door 6 provided openable and closable with respect to the casing 2, a main body unit 3 incorporated into the casing 2, and a detachable unit 4 assembled to the open-close door 6.

The casing 2 is molded of a plastic or metal material, and is formed into a box shape having an inlet (opening) 2*a* on its upper portion. Inside the casing 2, there is provided a placing base 2*b* for placing thereon the paper roll R dropped in through the inlet 2*a*. The placing base 2*b* is formed to be curved in an arc-shaped manner, and the cylindrical paper roll R can be placed on the placing base 2*b* stably.

On the upper surface of the casing 2, the open-close door 6 is attached and fixed to be openable and closable through the intermediation of a hinge portion 5. The open-close door 6 turns within a range of constant angle in between a closed state illustrated in FIG. 1 and an opened state illustrated in FIG. 2. Then, the inlet 2*a* appears when the open-close door 6 is opened, and thus the paper roll R can be dropped into the casing 2, or taken out of the casing 2. Further, design is made such that a slight gap is provided between the forward end of the open-close door 6 and the casing 2 when the open-close door 6 is closed. Then, with use of this gap, the recording sheet P is drawn out from the inside of the casing 2. That is, this gap functions as a delivery port 2*c* of the recording sheet P (see FIG. 1). Further, at the front end portion of the casing 2, there is formed a feeding paper cover 2*d* protruding to the inner side (rear side) of the casing 2 and extending to the vicinity of the front end portion of the main body unit 3. The printed recording sheet P passes over the feeding paper cover 2*d* toward the delivery port 2*c*.

(Detachable Unit)

Figure 3:
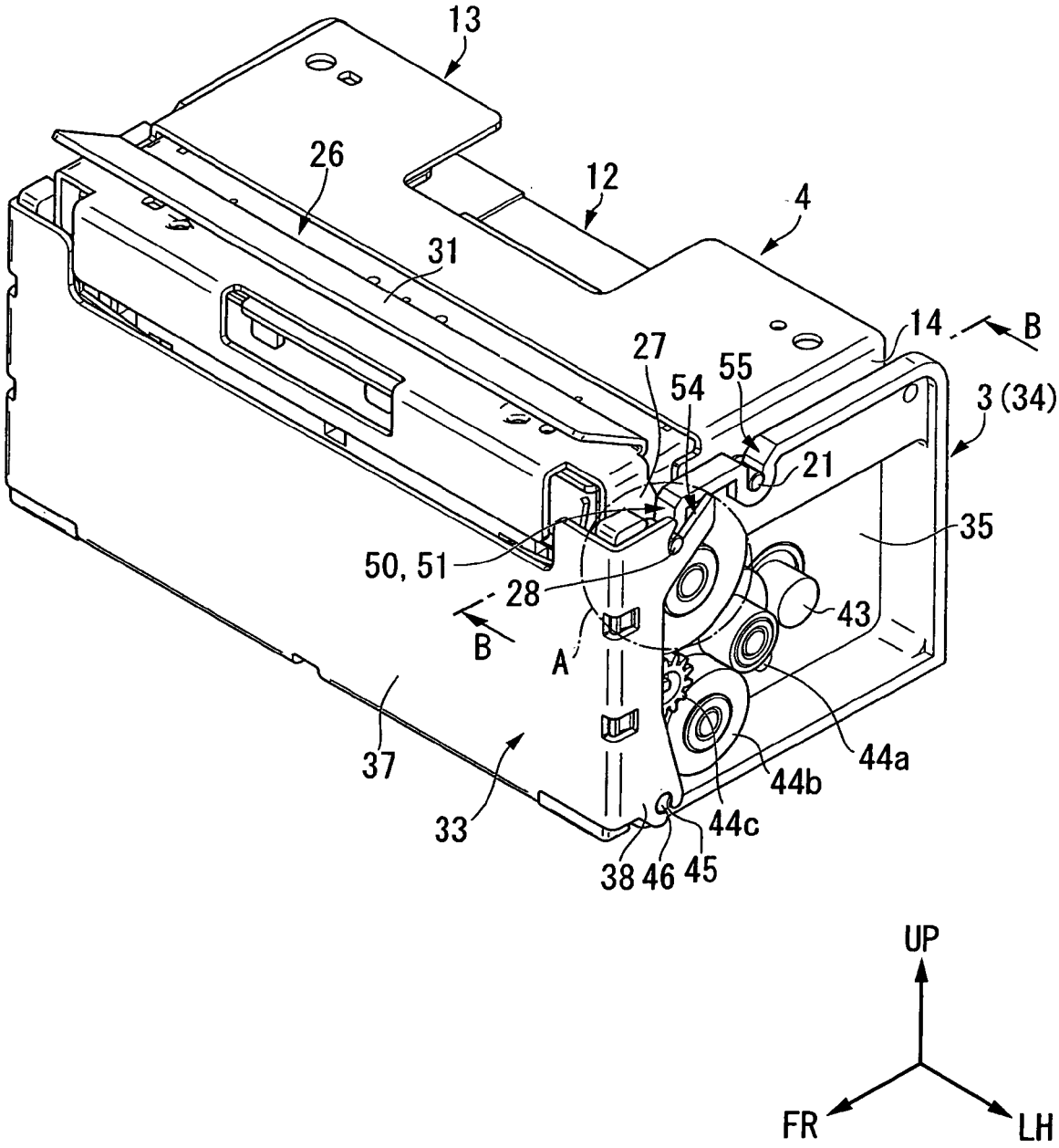
FIG. 3 is a perspective view illustrating a state in which a main body unit and a detachable unit are mounted to each other.
Figure 4:
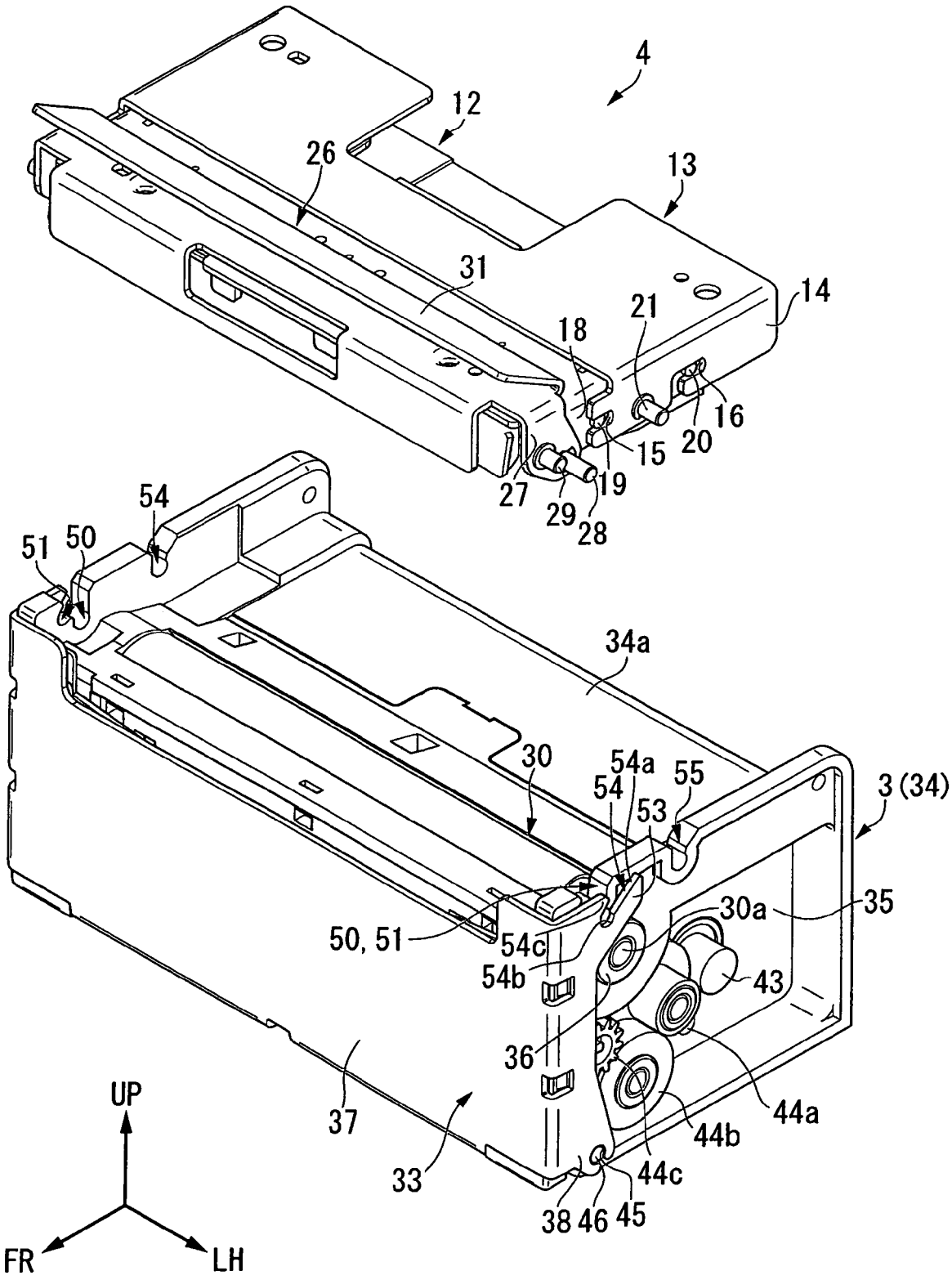
FIG. 4 is an exploded perspective view illustrating a state in which the main body unit and the detachable unit are dismounted to each other.
Figure 5:
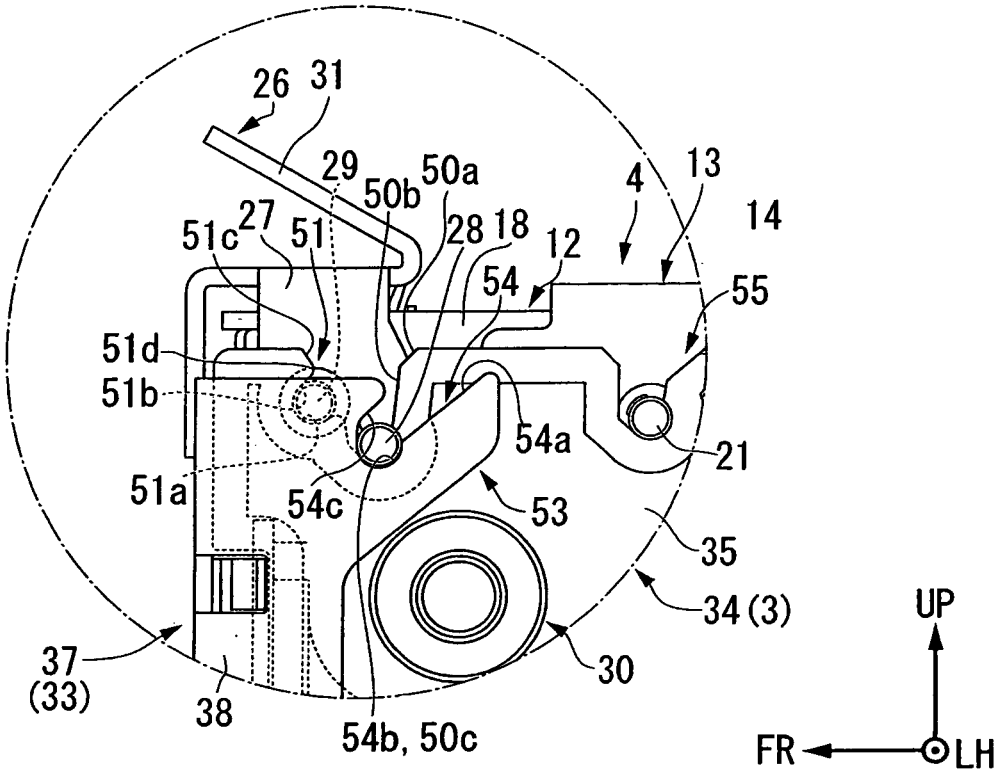
FIG. 5 is an enlarged side view of a part A of FIG. 3.
Figure 6:
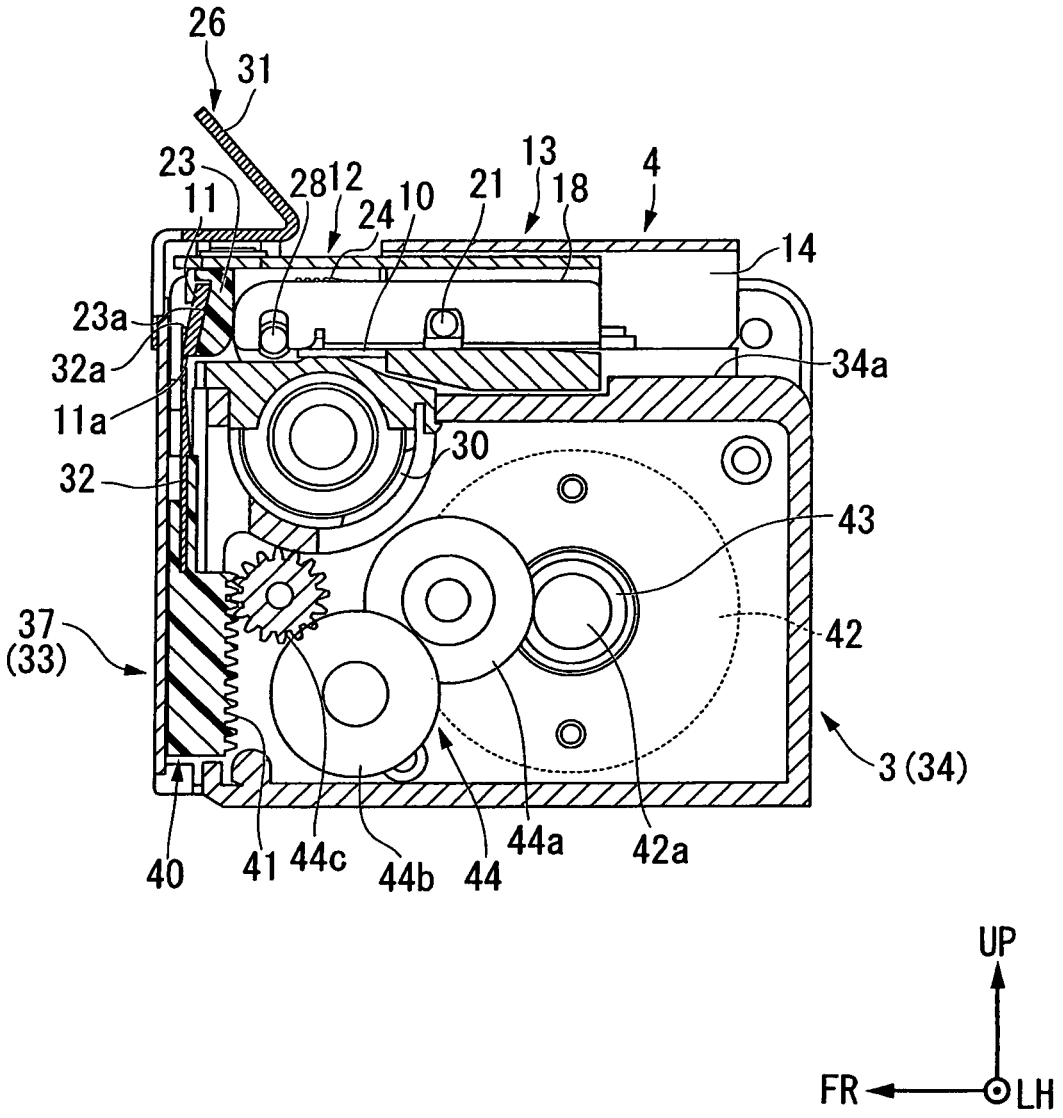
FIG. 6 is a sectional view taken along the line B-B of FIG. 3.
Figure 7:
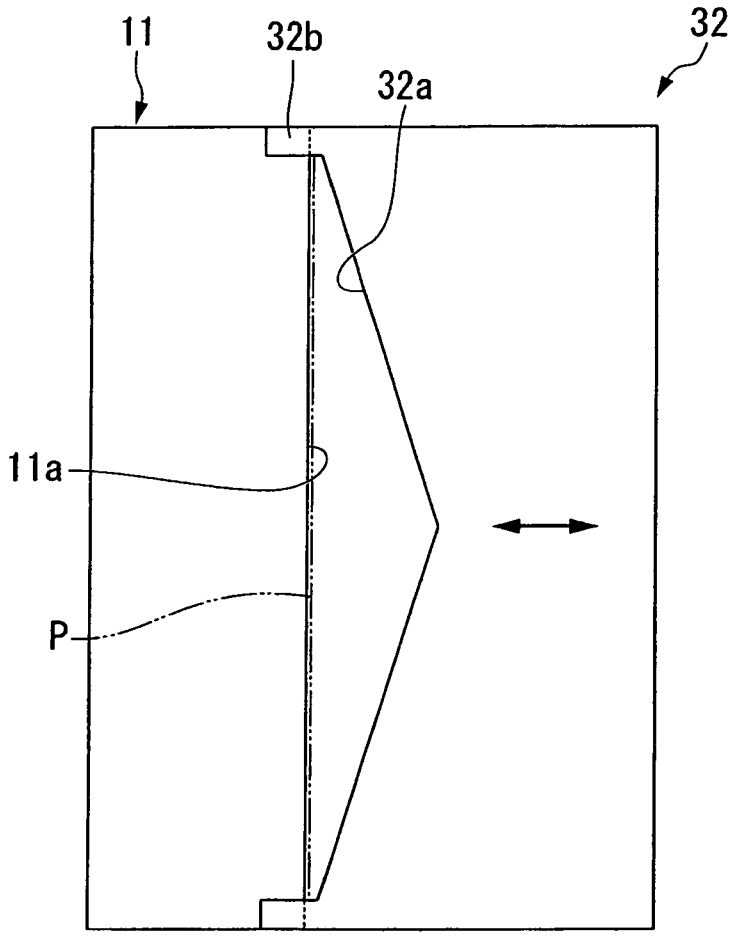
FIG. 7 is a plan view of a cutter mechanism.

FIG. 3 is a perspective view illustrating a state in which the main body unit and the detachable unit are mounted to each other, and FIG. 4 is an exploded perspective view illustrating a state in which the main body unit and the detachable unit are dismounted to each other. Further, FIG. 5 is an enlarged side view of a part A of FIG. 3. Further, FIG. 6 is a sectional view taken along the line B-B of FIG. 3, and FIG. 7 is a plan view of a cutter mechanism. Note that, for convenience of description, the above-mentioned casing 2 and the open-close door 6 are omitted in FIGS. 3 to 6.

As illustrated in FIGS. 2 to 7, the detachable unit 4 is assembled to the front inner surface of the open-close door 6. The detachable unit 4 moves together with the open-close door 6, and can be detachably mounted to the main body unit 3. The detachable unit 4 mainly includes a fixed blade (second blade) 11, a thermal head 10 (see FIG. 2), a head support frame 17 fixing the thermal head 10, a fixed blade frame (second blade frame) 12 holding the head support frame 17 and the fixed blade 11, and an attachment frame 13 supporting the fixed blade frame 12 and fixing the detachable unit 4 to the open-close door 6.

The attachment frame 13 is a U-shaped plate, which is made of metal or the like and is formed such that its both sides in a lateral direction of the recording sheet P are bent downward. The upper surface of the attachment frame 13 is attached to the inner surface of the open-close door 6 while facing the inner surface thereof. A pair of cutouts 15 (see FIG. 4) extending from the front to rear side of the attachment frame 13 is formed in front end edges of both side surfaces 14 of the attachment frame 13. A pair of L-shaped cutouts 16 extending from the lower peripheral edges of the attachment frame 13 in a height direction is formed in the center portions of the both side surfaces of the attachment frame. Further, the fixed blade frame 12 to which the head support frame 17 and the fixed blade 11 are incorporated is held inside the attachment frame 13.

Similarly to the attachment frame 13, the fixed blade frame 12 is a plate, which is made of metal or the like and is formed such that its both sides in the lateral direction of the recording sheet P are bent downward. The fixed blade frame 12 has a length in a longitudinal direction (conveying direction of recording sheet P) larger than that of the attachment frame 13, and is held in the attachment frame 13 in a state of protruding from the front end of the attachment frame 13. Specifically, engagement pins 19 and 20 (see FIG. 4) protruding along the lateral directions are formed at center portions and rear end portions of both side surfaces 18 of the fixed blade frame 12. Those engagement pins 19 and 20 are engaged with the above-mentioned cutouts 15 and 16, respectively. As a result, the attachment frame 13 and the fixed blade frame 12 are incorporated with each other. Note that, the engagement pins 19 and 20 can slide in the cutouts 15 and 16 along the conveying direction (longitudinal direction) of the recording sheet P. That is, even if an assembly position between the detachable unit 4 and the main body unit 3 is slightly misaligned in the longitudinal direction when the open-close door 6 is closed, a slide mechanism between the attachment frame 13 and the fixed blade frame 12 absorbs this misalignment, and hence it is possible to reliably assemble the detachable unit 4 to the main body unit 3.

Further, in the side surfaces 14 of the attachment frame 13 and the side surfaces 18 of the fixed blade frame 12, there are formed through holes (not shown) passing therethrough along the lateral direction (width direction of recording sheet P). An auxiliary shaft 21 is inserted through the through holes. The auxiliary shaft 21 functions as a stopper for stopping sliding movement of the fixed blade frame 12 with respect to the attachment frame 13. When the fixed blade frame 12 slides in the longitudinal direction, the auxiliary shaft 21 comes into contact with the peripheral edges of the through holes, to thereby regulate further sliding. Further, the auxiliary shaft 21 serves as a rotation fulcrum of the head support frame 17.

Further, the thermal head (print head) 10 is supported on the inner side of the center portion in the longitudinal direction of the fixed blade frame 12 through the intermediation of the head support frame 17, and can operate while using the auxiliary shaft 21 as the rotation fulcrum as described above. The thermal head 10 is formed so as to extend in the width direction (lateral direction) of the recording sheet P, and a large number of heating elements (not shown) are aligned on the surface (lower surface) of the thermal head along the lateral direction. Further, the thermal head 10 is arranged at a position of being opposed to an outer peripheral surface of a platen roller 30 described below when the open-close door 6 is closed. That is, the lower surface of the thermal head 10 serves as a passing surface for the recording sheet P, and the recording sheet P is conveyed while its print surface is directed upward (while the recording sheet P is opposed to the thermal head 10). With this, the recording sheet P is discharged from the delivery port 2*c* of the casing 2 while its print surface is directed upward, and hence a user can instantly recognize characters and figures printed on the recording sheet P.

The thermal head 10 is biased toward the platen roller 30 (downward) by a biasing means 22 (see FIG. 2) such as a coil spring provided between the back surface (upper surface) of the head support frame 17 and the lower surface of the fixed blade frame 12. With this, it is possible to reliably press the thermal head 10 against the recording sheet P sent out by the platen roller 30, and thus satisfactory printing is possible.

The fixed blade 11 is supported on the forward end side of the fixed blade frame 12. The fixed blade 11 has a plate shape extending along the width direction of the recording sheet P (see FIG. 7), and is arranged adjacently on the front side of the thermal head 10 (downstream side in conveying direction of recording sheet P). Specifically, the fixed blade 11 is fixed on a front surface side of a fixed blade holder 23 arranged between the thermal head 10 and the fixed blade 11 while a cutting edge 11*a* is directed downward. That is, the fixed blade 11 is fixed such that the cutting edge 11*a* is opposed to a surface on which printing is performed of the recording sheet P when the open-close door 6 is closed. Specifically, the fixed blade 11 is fixed while being slightly inclined forward from its blade root toward the cutting edge 11*a*.

The fixed blade holder 23 is a plate-shaped member made of resin or the like, and has, on its front surface side, an inclined surface 23*a* inclined forward from the upper portion toward the lower portion thereof. The fixed blade 11 is held on the inclined surface 23*a*. Further, the fixed blade holder 23 is supported so as to slightly swing with respect to the fixed blade frame 12 while using its upper end portion as a fulcrum, and so as to slide in a horizontal direction along the inner surface of the fixed blade frame 12. The cutting edge 11*a* side of the fixed blade 11 fixed to the fixed blade holder 23 can move in the longitudinal direction (conveying direction of recording sheet P). A biasing means 24 (see FIG. 2) such as a coil spring is provided on the rear surface side of the fixed blade holder 23, and thus the fixed blade holder 23 (fixed blade 11) is biased so as to be pushed out forward.

On the front end side of the fixed blade frame 12, a lever member 26 is turnably attached to the fixed blade frame 12 so as to cover the fixed blade frame 12 from the front end side thereof. The lever member 26 is made of metal or the like, and its both right and left sides and front end side are bent downward. Through holes (not shown) are formed in both side surfaces 27 of the lever member 26 and the both side surfaces 18 of the fixed blade frame 12 (see FIG. 4), and a guide shaft 28 is inserted through the through holes. Further, while using the guide shaft 28 as a fulcrum, the lever member 26 is turnably supported with respect to the fixed blade frame 12 in a direction orthogonal to the conveying direction of the recording sheet P (vertical direction). Further, in the obliquely front of the guide shaft 28, there is formed a pair of lock pins 29 respectively protruding from the both side surfaces 27 of the lever member 26 in the lateral direction of the lever member 26. The lock pins 29 are formed to extend parallel to the guide shaft 28 and have a protruding amount smaller than that of the guide shaft 28 protruding from the side surfaces 27 of the lever member 26. Further, when the lever member 26 turns, the lock pins 29 move along an arc track around the guide shaft 28.

Further, a manipulating portion 31 bent obliquely forward is formed at the rear end of the lever member 26. The manipulating portion 31 protrudes from the upper surface of the open-close door 6. The lever member 26 turns rearward by tilting the manipulating portion 31 rearward, and locking by a latch mechanism described below is canceled, to thereby open the open-close door 6. Further, the lever member 26 is biased forward (in a direction in which the open-close door 6 is closed) by a biasing means (not shown). Note that, lever members 26 may be provided independently on the right and left sides of the guide shaft 28, respectively.

(Main Body Unit)

Figure 8:
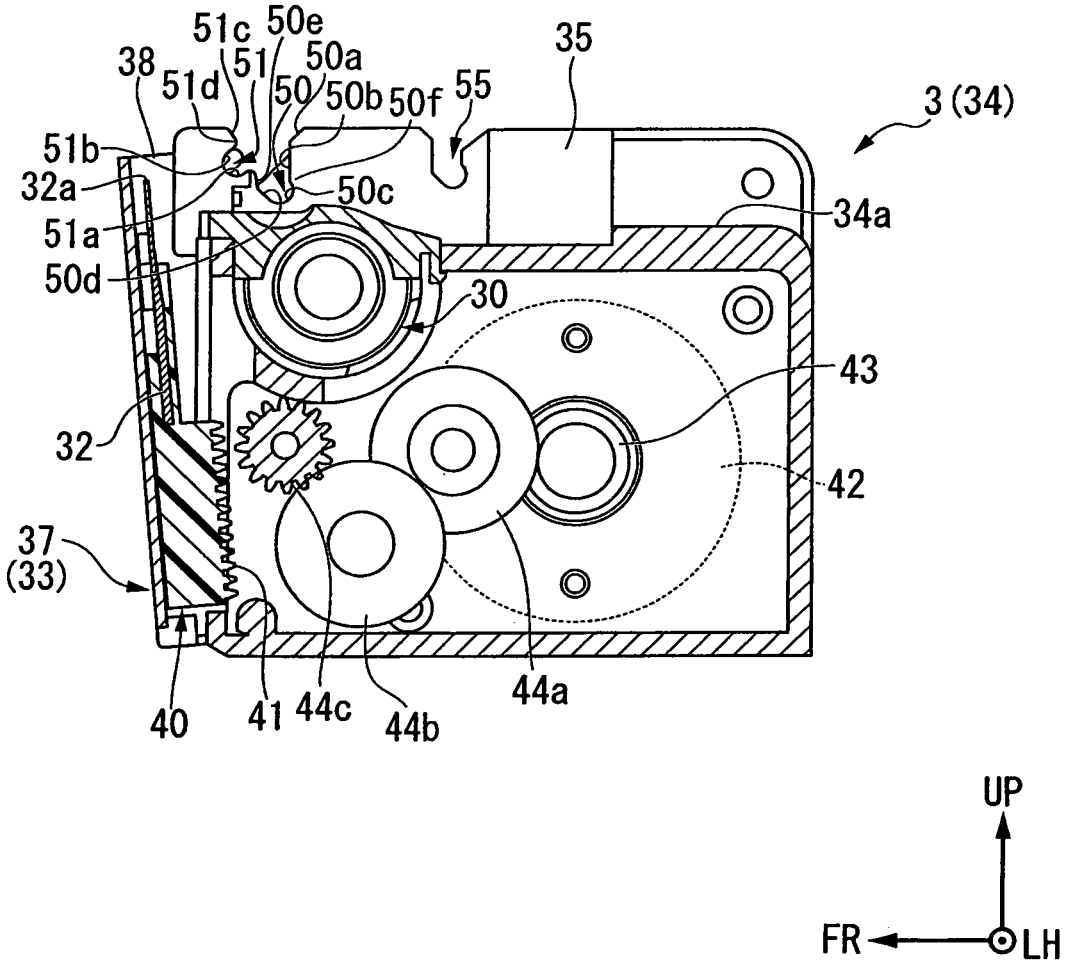
FIG. 8 is a sectional view illustrating a state in which the detachable unit in the state of FIG. 6 is dismounted from the printer.

FIG. 8 is a sectional view illustrating a state in which the detachable unit in the state of FIG. 6 is dismounted from the printer.

As illustrated in FIGS. 2 to 8, the main body unit 3 mainly includes the platen roller 30, a movable blade (first blade) 32, a movable blade frame (first blade frame) 33 slidably supporting the movable blade 32, and a main body frame 34 supporting the platen roller 30, the movable blade 32, and the movable blade frame 33.

The main body frame 34 is a box-shaped member, which is formed of a metal plate, a resin molded article, or the like, and its upper surface 34*a* serves as a passing surface for the recording sheet P. The recording sheet P is conveyed in a state in which a back surface of the surface on which printing is performed of the recording sheet P faces the upper surface 34*a* and the lateral direction of the upper surface 34*a* and the width direction of the recording sheet P correspond to each other.

The platen roller 30 is provided on the front side of the main body frame 34. The platen roller 30 includes a shaft 30*a* (see FIG. 2) extending along the width direction of the recording sheet P, and a roller main body 30*b* which is made of rubber or the like and provided externally on the shaft 30*a*. Both ends of the shaft 30*a* are rotatably supported to side plates 35 of the main body frame 34 through the intermediation of bearing members 36. Note that, a gear (not shown) meshing with a gear train mechanism (not shown) is fixed on one end side of the shaft 30*a*. Further, a driving force from a drive means (not shown) such as a motor provided to the main body frame 34 is transmitted to the gear through the gear train mechanism, and thus the platen roller 30 can be rotated. The roller main body 30*b* of the platen roller 30 is exposed from the upper surface of the main body frame 34. The platen roller 30 is arranged under a predetermined pressure (so-called head pressure) by the biasing means 22 such that its outer peripheral surface is held in contact with the above-mentioned thermal head 10 while sandwiching the recording sheet P drawn out of the paper roll R between the thermal head 10 and the platen roller 30 when the open-close door 6 is closed. Then, in a state in which the recording sheet P is sandwiched between the platen roller 30 and the thermal head 10, owing to rotation of the platen roller 30, the recording sheet P drawn out of the paper roll R can be sent out to the front side of the casing 2 through the delivery port 2*c*.

The movable blade frame 33 is a plate made of metal or the like, which includes a front wall 37 arranged so as to cover the front surface side of the main body frame 34, and side walls 38 (see FIG. 4) obtained by bending both sides in the width direction of the front wall 37 rearward in a U-shaped manner.

Fit-engagement portions 45 obtained by cutting corner portions of the side walls 38 are formed in the lower portions of the side walls 38 of the movable blade frame 33. A coupling pin 46 protruding from the side plates 35 of the main body frame 34 are fit-engaged with the fit-engagement portions 45. Further, the movable blade frame 33 is formed to be turnable about the coupling pin 46 with respect to the main body frame 34. Specifically, the movable blade frame 33 is configured to be turnable in a direction in which the front wall 37 and the front surface of the main body frame 34 are brought close to or separated from each other, that is, in a direction generally orthogonal to the sliding direction of the movable blade 32 (direction along conveying direction of recording sheet P). In this case, the position at one end of the movable blade frame 33 (position closest to main body frame 34: see FIGS. 1, 3, 5, and 6) is a home position of the movable blade frame 33, and the position at the other end of the movable blade frame 33 (position farthest from main body frame 34: see FIGS. 2 and 4) is a separated position of the movable blade frame 33. Note that, a biasing means 47 (see FIG. 1) such as a coil spring for biasing the movable blade frame 33 to the separated position is provided between the movable blade frame 33 and the main body frame 34.

Further, at the separated position of the movable blade frame 33, the front wall 37 of the movable blade frame 33 is tilted to the inner side (front side) with respect to the feeding paper cover 2*d* of the casing 2. With this, at the separated position of the movable blade frame 33, even if the movable blade 32 slides upward from the movable blade frame 33, the movable blade 32 comes into contact with the inner surface of the feeding paper cover 2*d* of the casing 2, and hence the movable blade 32 cannot protrude from the movable blade frame 33. That is, the inner surface side of the feeding paper cover 2*d* functions as a stopper for preventing protruding of the movable blade 32, and can prevent protruding of the movable blade 32 from the movable blade frame 33 at the separated position of the movable blade frame 33. Therefore, ease of maintenance is improved, and a burden on a user can be alleviated. Further, a user cannot access the movable blade 32 directly, and hence safety is ensured.

The movable blade 32 capable of sliding along a surface direction (vertical direction) of the front wall 37 of the movable blade frame 33 is provided between the front surface of the main body frame 34 and the front wall 37 of the movable blade frame 33. As illustrated in FIG. 8, the movable blade 32 constitutes the cutter mechanism (cutter) in cooperation with the above-mentioned fixed blade 11. The movable blade 32 is a plate-shaped blade having a substantially V-shape in plan view, and is formed such that its length from a blade root to a cutting edge 32*a* is gradually decreased from the both ends toward the center thereof (such that the movable blade 32 is separated from the fixed blade 11). The movable blade 32 is held by a movable blade holder 40 and slidably supported so as to be substantially orthogonal to the surface on which printing is performed of the recording sheet P.

Further, at the both end portions in the width direction of the movable blade 32, there are formed introducing portions 32*b* formed to protrude from the cutting edge 32*a* and extending parallel to the surface direction of the movable blade 32. Further, in a state of the home position of the movable blade frame 33, the movable blade 32 is held in a state in which the introducing portions 32*b* climb onto the both end portions of the cutting edge 11*a* of the fixed blade 11 (see FIGS. 7 and 11C). Therefore, when the movable blade 32 slides with respect to the fixed blade 11, the fixed blade 11 is pushed rearward by the movable blade 32. However, the fixed blade 11 is biased forward by the biasing means 24, and hence the both blades 11 and 32 are held in contact with each other at a moderate contact pressure. In this case, at the time of sliding, the cutting edge 32*a* of the movable blade 32 and the cutting edge 11*a* of the fixed blade 11 are held in not surface-contact but point-contact with each other at two points. Then, as the movable blade 32 slides, the two point-contact points gradually move from the both ends of the movable blade 32 toward the center thereof. Therefore, it is possible to cut the recording sheet P finely.

As illustrated in FIGS. 2 to 8, the movable blade holder 40 is a plate-shaped member made of resin or the like, and is slidably supported on a guide (not shown) formed in the vertical direction of the movable blade frame 33. Further, the movable blade holder 40 holds the both sides in the lateral direction and the lower portion of the movable blade 32. With this, the movable blade 32 can slide in a direction substantially orthogonal to the surface on which printing is performed of the recording sheet P (vertical direction). Further, a biasing means (not shown) such as a coil spring is provided between the movable blade holder 40 and the movable blade frame 33, and biases the movable blade holder 40 in a direction in which the movable blade holder 40 (movable blade 32) is separated from the cutting edge 11*a* of the fixed blade 11, that is, in a direction in which the movable blade 32 retreats into the movable blade frame 33. Further, a rack 41 (see FIG. 6) is formed on one side portion or both side portions of the movable blade holder 40 along the vertical direction of the movable blade holder 40. Regarding the rack 41, as a movable blade driving system, there are provided a drive means 42 such as a motor provided on the rear portion side of the main body frame 34, and a gear train mechanism 44 (see FIG. 6) meshing with a drive gear 43 coupled to a shaft 42*a* of the drive means 42, for transmitting a drive force from the drive means 42 to the rack 41.

The gear train mechanism 44 includes a first gear 44*a*, a second gear 44*b*, and a third gear 44*c* for moving the rack 41 along the vertical direction of the movable blade frame 33. Those gears 44*a*, 44*b*, and 44*c* are rotatably provided to one of the side plates 35 of the main body frame 34. Further, when the drive gear 43 rotates owing to driving of the drive means 42 at the home position of the movable blade frame 33, the drive force is transmitted to the rack 41 through the gears 44*a*, 44*b*, and 44*c*, and thus the movable blade holder 40 slides in the vertical direction.

In contrast, when the movable blade frame 33 turns from the home position to the separated position, meshing between the rack 41 of the movable blade holder 40 and the third gear 44*c* is released, and hence the drive force from the drive means 42 is not transmitted. Then, when meshing with the third gear 44*c* is released, the movable blade 32 is biased downward by the biasing means and retreats from the upper portion of the movable blade frame 33 to an initial position. Note that, the main body unit 3 is provided with a control substrate (not shown) on which various electronic devices are mounted. The control substrate outputs electric signals and control signals to the thermal head 10, or outputs control signals to a drive means (drive means 42, for example) for driving the platen roller 30 and the movable blade 32, to thereby control respective components comprehensively.

(Ratchet Mechanism)

Here, the detachable unit 4 is configured to be detachable with respect to the main body unit 3 (movable blade frame 33 and main body frame 34) by a ratchet mechanism.

First, as illustrated in FIGS. 4, 5, and 8, the both side plates 35 of the main body frame 34 protrude from the upper surface 34*a* of the main body frame 34 along the vertical direction, and a pair of a first recess 50 and a second recess 51 obtained by cutting each of the side plates 35 in the height direction is formed at the front upper end edge of each of the side plates 35.

Each of the first recesses 50 receives and holds the guide shaft 28 of the above-mentioned lever member 26. The first recess 50 has, at its inner peripheral edge, a first inclined portion 50*a* obtained by cutting the side plate 35 from the upper end edge thereof obliquely forward, a first guide portion 50*b* obtained by cutting the side plate 35 from the forward end of the first inclined portion 50*a* downward, a receiving portion 50*c* obtained by cutting the side plate 35 from the forward end of the first guide portion 50*b* rearward, for receiving the guide shaft 28, a second inclined portion 50*d* formed to extend from the receiving portion 50*c* obliquely forward, and a second guide portion 50*e* extending from the forward end of the second inclined portion 50*d* upward and having a length smaller than that of the first guide portion 50*b*. Further, a regulating portion (first regulating portion) 50*f* for regulating upward movement of the guide shaft 28 held in the receiving portion 50*c* is formed at the boundary between the receiving portion 50*c* and the first guide portion 50*b*.

Each of the second recesses 51 is formed so as to be continuous obliquely forward with each of the first recesses 50, and receives and holds each of the lock pins 29 of the above-mentioned lever member 26. Each of the second recesses 51 has a receiving portion 51*a* obtained by cutting the side plate 35 obliquely forward from the forward end of the second guide portion 50*e* of each of the first recesses 50, for receiving each of the lock pins 29, a first inclined portion (guide portion) 51*b* formed to extend from the receiving portion 51*a* obliquely rearward, and a second inclined portion 51*c* formed to extend obliquely upward from the forward end of the first inclined portion 51*b* up to the upper end edge of the side plate 35. Note that, in a state in which the guide shaft 28 is held in the first recesses 50, the first inclined portion 51*b* of each of the second recesses 51 is formed to be larger than a track (arc radius) of the lock pins 29 turning about the guide shaft 28. Further, at the boundary between the first inclined portion 51*b* and the second inclined portion 51*c* of each of the second recesses 51, there is formed a regulating portion (second regulating portion) 51*d* for regulating upward movement of the lock pin 29 and for guiding the lock pin 29 to escape from the receiving portion 51*a* when the lever member 26 turns about the guide shaft 28. Note that, at the initial position (state illustrated in FIG. 5) of the lever member 26, a distance in the longitudinal direction between the first inclined portion 50*a* of the first recess 50 and the regulating portion 51*d* of the second recess 51 is smaller than a distance in the longitudinal direction between the guide shaft 28 and each of the lock pins 29.

Further, a pair of extending portions 53 (see FIG. 5) having a triangular shape in plan view and extending so as to be inclined upward to the rear is formed at the upper rear end edges of the both side walls 38 of the movable blade frame 33. Further, at the forward end portions of the extending portions 53, there are formed third recesses 54 to be engaged with the above-mentioned guide shaft 28 at the home position of the movable blade frame 33. The third recesses 54 are formed so as to overlap the first recesses 50 in the width direction of the recording sheet P at the home position of the movable blade frame 33. Specifically, each of the third recesses 54 has a guide portion 54*a* obtained by cutting each of the extending portions 53 from the upper end edge thereof obliquely forward, a receiving portion 54*b* formed at the forward end of the guide portion 54*a*, for receiving the guide shaft 28, and a hook portion 54*c* formed at the forward end of the receiving portion 54*b* and extending parallel to the inclined surface of the guide portion 54*a*.

Further, the guide shaft 28 and the lock pins 29 formed in the detachable unit 4 and the first to third recesses 50, 51, and 54 formed in the main body unit 3 constitute the ratchet mechanism for detachably mounting the detachable unit 4 to the main body unit 3. Further, the detachable unit 4 is configured to be detachable from a mounted position (see FIGS. 1, 3, 5, and 6) in which the guide shaft 28 and the lock pins 29 are held in the first to third recesses 50, 51, and 54 and mounted to the main body unit 3 to a dismounted position (see FIGS. 2, 4, and 7) in which the guide shaft 28 and the lock pins 29 are released from the first to third recesses 50, 51, and 54 and separated from the main body unit 3. That is, the detachable unit 4 is configured to be turnable in the direction in which the movable blade 32 slides in accordance with open-close operation of the open-close door 6 (direction orthogonal to surface on which printing is performed of recording sheet P). In this case, the above-mentioned guide portion 54*a* of each of the third recesses 54 guides the guide shaft 28 such that the movable blade frame 33 moves to the home position when the detachable unit 4 moves to the mounted position, and guides the guide shaft 28 such that the movable blade frame 33 moves to the separated position when the detachable unit 4 moves to the dismounted position. Note that, detailed description of specific operation of the ratchet mechanism is made later.

As described above, in this embodiment, the detachable unit 4 turns from the mounted position to the dismounted position along the sliding direction of the movable blade 32. Meanwhile, the movable blade frame 33 turns from the home position to the separated position in the direction orthogonal to the sliding direction of the movable blade 32. That is, the detachable unit 4 is engaged with both the movable blade frame 33 and the main body frame 34 by the ratchet mechanism in the state at the mounted position, and engagement between the movable blade frame 33 and the main body frame 34 is released at the dismounted position. Therefore, in conjunction with turning operation of the detachable unit 4, locking between the main body frame 34 and the movable blade frame 33 is canceled, and thus the movable blade frame 33 turns.

Note that, at the center portions in the longitudinal direction of the side plates 35 of the main body frame 34, there are formed fourth recesses 55 obtained by cutting the side plates 35 from the upper end edges thereof in the vertical direction. At the mounted position of the detachable unit 4, the fourth recesses 55 receive the above-mentioned auxiliary shaft 21 inserted through the fixed blade frame 12, to thereby position the detachable unit 4 with respect to the main body unit 3.

(Operating Method for Thermal Printer)

Next, an operating method for the above-mentioned thermal printer is described.

First, as illustrated in FIG. 2, the paper roll R is dropped into the casing 2 through the inlet 2*a* in a state in which the open-close door 6 is opened. In this case, the recording sheet P is drawn out to the outside of the casing 2 by a certain length in advance. Then, in a state in which the drawn-out recording sheet P is in the outside of the casing 2, the open-close door 6 is closed, and the open-close door 6 is locked by the above-mentioned ratchet mechanism. With this, as illustrated in FIG. 1, the recording sheet P is sandwiched between the platen roller 30 and the thermal head 10, and enters the state of being drawn out to the outside of the casing 2 from the delivery port 2*c*.

(Operation of Ratchet Mechanism)

Figure 9A:
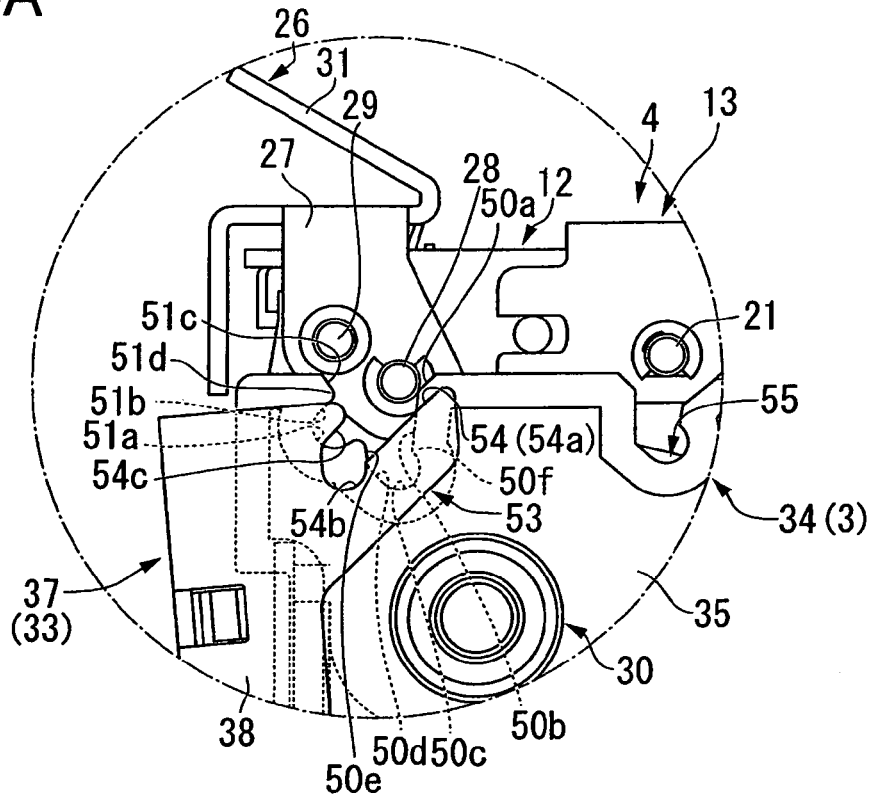
FIG. 9 are enlarged side views corresponding to the part A of FIG. 3, illustrating operations in a first embodiment.
Figure 9B:
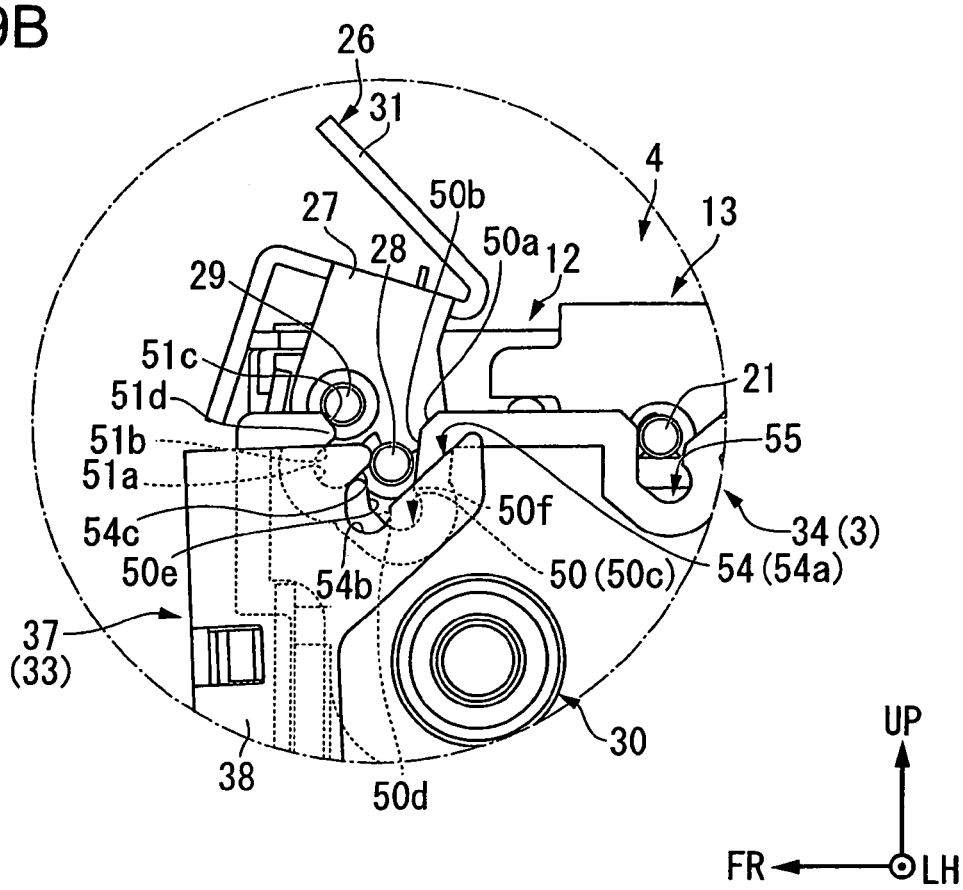
Figure 10A:
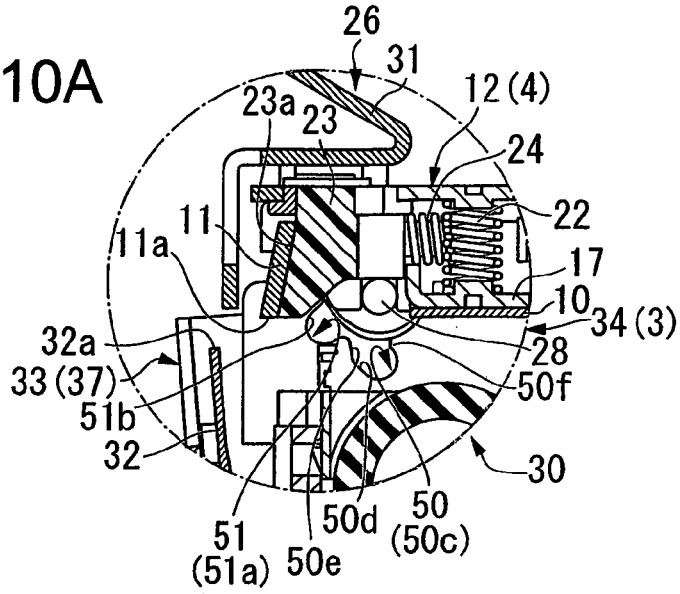
FIG. 10 are enlarged sectional views corresponding to the part A of FIG. 3, illustrating the operations in the first embodiment.
Figure 10B:
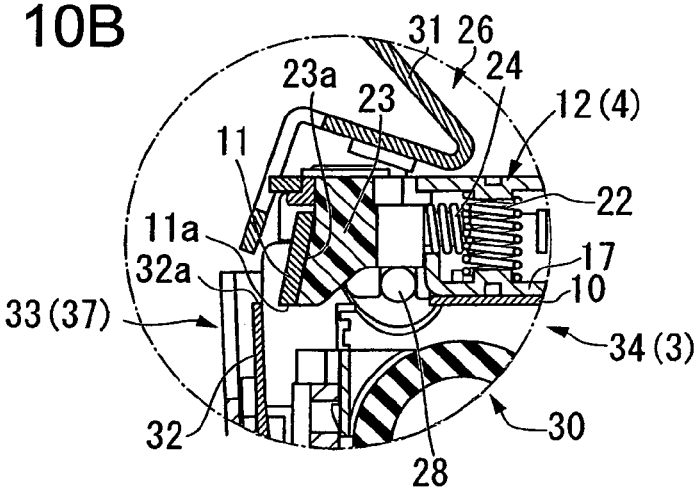
Figure 10C:
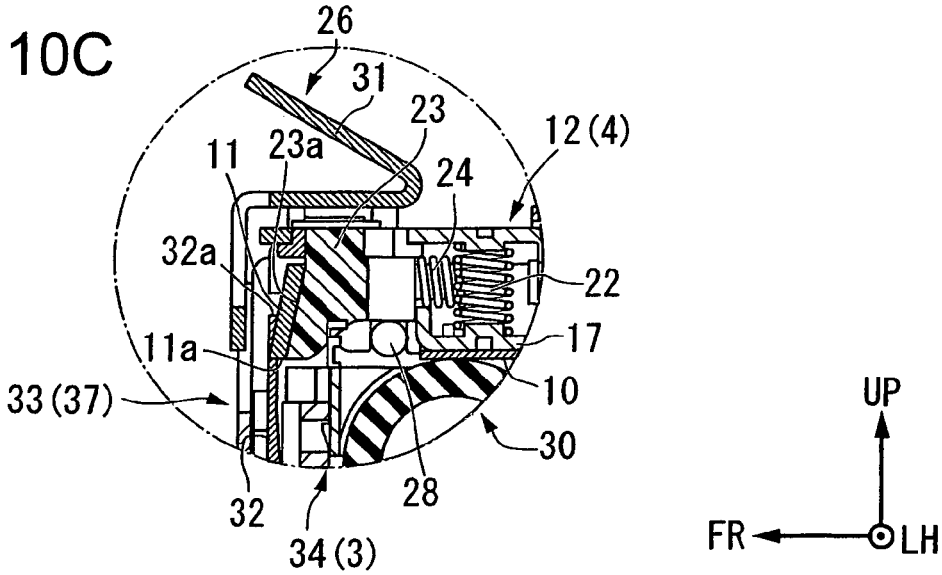
Figure 11A:
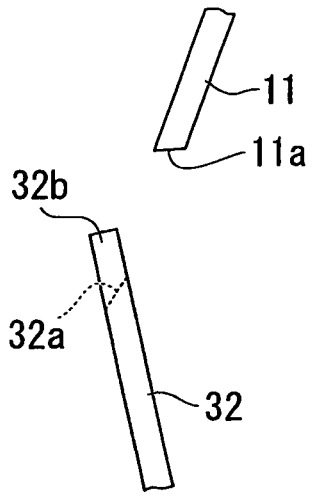
FIG. 11 are explanation views illustrating an arrangement relation in the cutter mechanism which varies in accordance with operation of the open-close door from an opened state to a closed state of the open-close door.
Figure 11B:
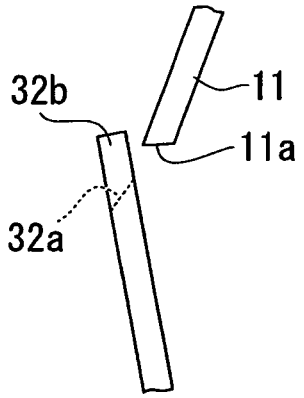
Figure 11C:
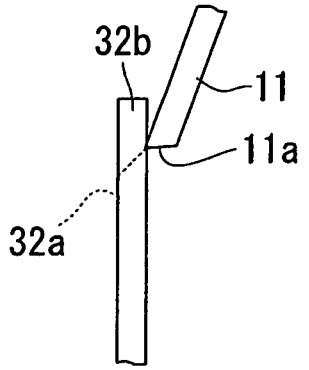

FIGS. 9 and 10 are explanation views illustrating operations in this embodiment. FIG. 9 are enlarged side views corresponding to the part A of FIG. 3, and FIG. 10 are enlarged sectional views. Further, FIG. 11 are explanation views illustrating an arrangement relation in the cutter mechanism which varies in accordance with operation of the open-close door from an opened state of the open-close door (FIG. 11A) to a closed state (FIG. 11C).

Here, operation of the above-mentioned ratchet mechanism is described.

First, as illustrated in FIGS. 9A and 10A, in a state in which the open-close door 6 is opened, the detachable unit 4 is at the dismounted position and the movable blade frame 33 is at the separated position of being separated from the main body frame 34. That is, meshing between the rack 41 of the movable blade holder 40 and the third gear 44*c* of the main body frame 34 is released, and the cutting edge 32*a* of the movable blade 32 and the cutting edge 11*a* of the fixed blade 11 are not held in contact with each other (see FIG. 11A).

In order to mount the detachable unit 4 to the main body unit 3, the detachable unit 4 is pushed downward through the intermediation of the open-close door 6. Then, the outer peripheral surface of the guide shaft 28 supporting the lever member 26 comes into contact with the first inclined portions 50*a* of the first recesses 50, and the guide shaft 28 slips off the first inclined portions 50*a*.

Further, as illustrated in FIGS. 9B and 10B, when the detachable unit 4 is pushed down by a predetermined distance, the outer peripheral surfaces of the lock pins 29 come into contact with the second inclined portions 51*c* of the second recesses 51. In this case, at the initial position (state illustrated in FIG. 9A) of the lever member 26, each distance in the longitudinal direction between the first inclined portions 50*a* of the first recesses 50 and the regulating portions 51*d* of the second recesses 51 is smaller than a distance in the longitudinal direction between the guide shaft 28 and each of the lock pins 29, and hence the outer peripheral surface of the guide shaft 28 is held in contact with the first inclined portions 50*a* of the first recesses 50, and the outer peripheral surfaces of the lock pins 29 are held in contact with the second inclined portions 51*c* of the second recess 51. Note that, in this state, as illustrated in FIG. 11B, the cutting edges 32*a* and 11*a* of the movable blade 32 and the fixed blade 11 are gradually brought close to each other.

Further, as illustrated in FIGS. 9B and 10B, when the detachable unit 4 is further pushed downward, the guide shaft 28 slips off the first inclined portions 50*a* of the first recesses 50 to reach the first guide portions 50*b*, and further slips off the first guide portions 50*b*. Then, a reaction force of a pushing force to push down the detachable unit 4 acts so as to lift the lock pins 29 upward through the second inclined portions 51*c* of the second recesses 51. Further, this reaction force is transmitted to the lever member 26 through the lock pins 29, and hence the lever member 26 turns rearward about the guide shaft 28. As a result, the lock pins 29 turn about the guide shaft 28, and the distance in the longitudinal direction between the guide shaft 28 and each of the lock pins 29 is reduced. Thus, the lock pins 29 slip off the second inclined portions 51*c* of the second recesses 51. Note that, in the state illustrated in FIGS. 9B and 10B, the auxiliary shaft 21 enters the fourth recesses 55.

When the guide shaft 28 slips off the first guide portions 50*b* of the first recesses 50, the outer peripheral surface of the guide shaft 28 comes into contact with the upper portions of the guide portions 54*a* of the third recesses 54 formed in the movable blade frame 33. Then, when the detachable unit 4 is further pushed downward, the guide shaft 28 slips off the first guide portions 50*b* of the first recesses 50 and the guide portions 54*a* of the third recesses 54. In this case, in the detachable unit 4, the guide shaft 28 and the lock pins 29 are held in the first recesses 50 and the second recesses 51, and hence the detachable unit 4 is regulated in its movement in the longitudinal direction. Therefore, the movable blade frame 33 moves relatively in a direction of being brought close to the front surface of the main body frame 34. That is, the pushing force to push down the detachable unit 4 acts on the guide portions 54*a* of the third recesses 54 through the guide shaft 28. As a result, the guide shaft 28 slips off the guide portions 54*a* of the third recesses 54, and the movable blade frame 33 is pulled toward the main body unit 3.

Meanwhile, in this state, the lock pins 29 pass over the second inclined portions 51*c* of the second recesses 51 and slip off the first inclined portions 51*b*. Then, the lever member 26 is biased forward by a biasing means (not shown), and hence the lock pins 29 turn (return) along the arc track about the guide shaft 28 in accordance with turning of the lever member 26. With this, the lock pins 29 slip off while sliding on the first inclined portions 51*b* of the second recesses 51.

Further, when the guide shaft 28 passes over the first guide portions 50*b* of the first recesses 50 and the guide portions 54*a* of the third recesses 54, the guide shaft 28 is received in the receiving portions 50*c* and 54*b* of the first recesses 50 and the third recesses 54. At the same time, the lock pins 29 slip off the first inclined portions 51*b* of the second recesses 51, and the lock pins 29 are received in the receiving portions 51*a* of the second recesses 51. With this, the detachable unit 4 enters the state at the mounted position of being mounted to the main body unit 3, and the movable blade frame 33 enters the state at the home position of being incorporated with the main body frame 34. That is, the detachable unit 4 is locked by the main body unit 3, and the open-close door 6 is closed (see FIGS. 5 and 10A). With this, the rack 41 of the movable blade holder 40 is meshed with the third gear 44*c* of the main body frame 34, and the introducing portions 32*b* of the movable blade 32 are held while climbing onto the both ends of the cutting edge 11*a* of the fixed blade 11 (see FIGS. 7 and 11C). As described above, in the state at the home position, the introducing portions 32*b* of the movable blade 32 are arranged so as to climb onto the cutting edge 11*a* of the fixed blade 11. As a result, the both blades 32 and 11 are held in contact with each other at a moderate contact pressure without forming bends for guiding in the introducing portions as in a conventional case. Therefore, it is possible to reduce manufacturing cost for forming bends. Note that, in this state, the auxiliary shaft 21 is also received in the fourth recesses 55, and hence the detachable unit 4 and the main body unit 3 are fixed to each other at two points in the longitudinal direction, that is, at the ratchet mechanism and at the auxiliary shaft 21 and the fourth recesses 55. With this, it is possible to stably hold the detachable unit 4 with respect to the main body unit 3 without backlash.

In this case, the movable blade frame 33 is biased toward the separated position by the biasing means 47 (see FIG. 1), and hence this biasing force acts on the guide shaft 28 through the receiving portions 54*b* of the third recesses 54 so as to push the guide shaft 28 forward. With this, the outer peripheral surface of the guide shaft 28 comes into contact with the second guide portions 50*e* of the first recesses 50, and the outer peripheral surfaces of the lock pins 29 are pressed against the inner peripheral surfaces of the receiving portions 51*a* of the second recesses 51 while being held in contact therewith. Therefore, it is possible to prevent backlash in the longitudinal direction at the mounted position of the detachable unit 4. Meanwhile, at the mounted position of the detachable unit 4, the upper outer peripheral surface of the guide shaft 28 is engaged with the regulating portions 50*f* of the first recesses 50 and the hook portions 54*c* of the third recesses 54, and the lock pins 29 are engaged with the regulating portions 51*d* of the second recesses 51. Thus, it is possible to prevent backlash in the vertical direction at the mounted position of the detachable unit 4. Therefore, it is possible to reliably position the detachable unit 4 with respect to the main body unit 3, and to stably hold the detachable unit 4. Note that, by pushing down the detachable unit 4 in a state in which the lever member 26 is pulled up rearward, that is, in a state in which the lever member 26 is tilted from the initial position, the guide shaft 28 and the lock pins 29 are smoothly guided into the first recesses 50 and the second recesses 51. Thus, it is possible to mount the detachable unit 4 more smoothly. Note that, basically, if there is an open-close fulcrum on the casing 2 side, the position of the detachable unit 4 is determined by the first recesses 50 and the third recesses 54, and hence it is unnecessary to form the second recesses 51 under the above-mentioned condition.

Further, after the paper roll R is set and the open-close door 6 is closed, various kinds of information is printed on the recording sheet P. Specifically, the drive means is operated by the control substrate, and the platen roller 30 is rotated. With this, the recording sheet P sandwiched between the outer peripheral surface of the platen roller 30 and the thermal head 10 is sent out to the front of the casing 2, and the paper roll R placed on the placing base 2*b* rotates. Further, at the same time, the thermal head 10 is operated via the control substrate. With this, a large number of heating elements generate heat appropriately. Thus, it is possible to clearly print various characters, figures, and the like on the sent-out recording sheet P. Thereafter, the recording sheet P, which is further sent out by the platen roller 30, passes through between the cutting edges 11*a* and 32*a* of the fixed blade 11 and the movable blade 32. Then, when the drive means 42 is operated and the movable blade 32 is slid upward, the cutting edge 32*a* of the movable blade 32 climbs onto the fixed blade 11 from the both sides in the width direction of the fixed blade 11, and the recording sheet P is sandwiched between the both blades 32 and 11 in a state in which a moderate contact pressure is imparted to the fixed blade 11. Thus, the recording sheet P onto which the printing is performed is separated from the recording sheet P onto which the printing is not performed, and the recording sheet P wound into the paper roll R can be used as a receipt, ticket, or the like.

(Clearing Method for Paper Jam)

Incidentally, at the time of cutting of the recording sheet, etc., when the recording sheet sent out from the paper roll is caught between the movable blade and the fixed blade, to thereby cause paper jam, there may arise a problem that the movable blade is stopped during sliding. In this case, if the detachable unit is intended to be turned in order to restore to the state before the problem arises, there is a problem that the detachable unit cannot be released due to contact of the movable blade with the fixed blade. In order to clear paper jam, it is necessary to forcibly move the movable blade manually with use of a knob or the like, and hence restoring work becomes complicated.

In this context, in this embodiment, when the movable blade 32 is stopped due to paper jam, the manipulating portion 31 of the lever member 26 is first pulled up and the lever member 26 is turned rearward. Then, the ratchet mechanism is operated in a way reverse to the above-mentioned way, and thus locking between the detachable unit 4 and the main body unit 3 is canceled.

Specifically, as illustrated in FIGS. 9B and 10B, when the lever member 26 is turned rearward, the lock pins 29 turn rearward along the arc track about the guide shaft 28, and the lock pins 29 slip out of the receiving portions 51*a* of the second recesses 51 to slide over the first inclined portions 51*b*. Then, after the lock pins 29 pass over the regulating portions 51*d* of the second recesses 51, regulation against the lock pins 29 in the vertical direction is canceled, and the lock pins 29 reach the second inclined portions 51*c* of the second recesses 51. At the same time, the guide shaft 28 slips out of the receiving portions 50*c* of the first recesses 50 to slide over the second inclined portions 50*d* obliquely forward, and the guide shaft 28 slips out of the receiving portions 54*b* of the third recesses 54 to reach the guide portions 54*a*.

In this case, the movable blade frame 33 is biased toward the separated position by the biasing means 47, and hence this biasing force acts on the guide shaft 28 through the guide portions 54*a* of the third recesses 54 so as to push the guide shaft 28 upward. With this, the guide shaft 28 passes over the regulating portions 50*f* of the first recesses 50 to be pushed up to the upper sides of the first recesses 50, and the lock pins 29 slide over the second inclined portions 51*c* of the second recesses 51 to be pushed up to the upper sides of the second recesses 51. With this, the detachable unit 4 is released from the main body unit 3 owing to releasing of the ratchet mechanism. Further, the detachable unit 4 moves to the dismounted position, and the movable blade frame 33 moves to the separated position, to thereby release meshing between the rack 41 of the movable blade holder 40 and the third gear 44*c*.

Thereafter, it is possible to open the open-close door 6 (see FIG. 1) by lifting the manipulating portion 31 upward as it is, and to remove the recording sheet P caught between the movable blade 32 and the fixed blade 11 by separating the detachable unit 4 from the main body unit 3 with a large space therebetween.

Here, in this embodiment, at the time of detachably mounting operation of the detachable unit 4, when the lever member 26 is pulled down and thus locking of the ratchet mechanism is canceled, the detachable unit 4 turns in a direction orthogonal to the surface on which printing is performed of the recording sheet P, that is, in the sliding direction of the movable blade 32. Therefore, as illustrated in FIGS. 11C to 11A, the track of the cutting edge 11*a* of the fixed blade 11 held in the detachable unit 4 extends along the substantially vertical direction.

Meanwhile, as illustrated in FIGS. 9B and 10B, when locking of the ratchet mechanism is canceled, the movable blade frame 33 turns about the coupling pin 46 in the conveying direction of the recording sheet P, that is, in a direction orthogonal to the sliding direction of the movable blade 32. Therefore, as illustrated in FIGS. 11C to 11A, similarly to the turning direction of the movable blade frame 33, the cutting edge 32*a* of the movable blade 32 held in the movable blade frame 33 exhibits a track inclined forward and downward.

Therefore, in conjunction with turning operation of the detachable unit 4 when moving to the dismounted position, locking between the main body frame 34 and the movable blade frame 33 is canceled, and the movable blade frame 33 also turns to the separated position. In this case, the movable blade 32 and the fixed blade 11 retreat in directions orthogonal to each other, respectively, and hence a contact pressure between the both blades 32 and 11 is promptly released. Thus, it is possible to release bite between the both blades 32 and 11. Further, the movable blade holder 40 is biased downward by the biasing means. Thus, when the movable blade frame 33 moves to the separated position and meshing between the rack 41 and the third gear 44*c* is released, the movable blade 32 immediately automatically retreats to the initial position of the movable blade frame 33 (downward). Therefore, bite between the both blades 32 and 11 is promptly released, and it is possible to restore the movable blade 32 easily.

As described above, in this embodiment, while the detachable unit 4 turns along the sliding direction of the movable blade 32, the movable blade frame 33 turns in a direction orthogonal to the sliding direction of the movable blade 32.

According to this configuration, the movable blade 32 and the fixed blade 11 retreat in directions orthogonal to each other, respectively, and hence the contact pressure between both blades 32 and 11 is promptly released at the time of turning of the detachable unit 4 and the movable blade frame 33.

Therefore, when paper jam or the like occurs, the movable blade 32 and the fixed blade 11 retreat in directions orthogonal to each other, respectively. Thus, even when the movable blade 32 is stopped during sliding and retreating of the both blades 32 and 11 is difficult, at the time of retreating of the both blades 32 and 11, the both blades 32 and 11 neither interfere with each other due to contact therebetween nor retreat while catching the recording sheet P therebetween. As a result, the movable blade frame 33 and the detachable unit 4 are easily moved to the separated position and the dismounted position, respectively, and thus it is possible to promptly release bite between the both blades 32 and 11. Thereafter, by removing the recording sheet P caught between the both blades 32 and 11, it is possible to easily perform restoring work for paper jam. Note that, even when the movable blade 32 is stopped due to intrusion of foreign matters, malfunction, and the like, it is possible to perform restoring work by the similar work. Therefore, even when there arises a problem that the movable blade 32 is stopped during sliding due to paper jam or the like, it is possible to easily restore the movable blade 32 to the state before the problem arises. Thus, it is possible to prevent a situation where the open-close door 6 cannot be opened.

In this case, by lifting the lever member 26 upward while being pulled down, it is possible to simultaneously perform a separating operation of the blades 32 and 11 from each other, a releasing operation of the ratchet mechanism, and an opening operation of the open-close door 6. That is, these operations can be performed in a single (one-time) operation, and hence it is possible to improve operativity.

Therefore, easy restoring of the movable blade 32 makes it possible to improve operativity, and a burden on a user can be alleviated. Further, unlike the conventional case, it is unnecessary to separately provide a knob or the like for forcibly moving the movable blade 32, and hence it is possible to reduce manufacturing cost as well.

Further, simultaneously with moving operation of the movable blade frame 33, it is possible to release meshing between the third gear 44*c* of the gear train mechanism 44 and the rack 41 of the movable blade holder 40. In this context, it is unnecessary to separately provide a lever or the like for releasing meshing between the gear train mechanism 44 and the rack 41, and hence it is possible not only to reduce manufacturing cost but also to further improve operativity.

In addition, the movable blade frame 33 is biased toward the separated position by the biasing means 47 (see FIG. 1). Thus, after engagement between the movable blade frame 33 and the detachable unit 4 is released, it is possible to move the movable blade frame 33 to the separated position automatically in conjunction with this releasing operation. Therefore, it is possible to perform restoring work of the movable blade 32 more easily.

Moreover, in this embodiment, in a state in which movement of the guide shaft 28 and the lock pins 29 is regulated at the mounted position by the regulating portions 50*f* of the first recesses 50 and the regulating portions 51*d* of the second recesses 51, respectively, the detachable unit 4 is mounted to the main body frame 34. With this, after reliably positioning the detachable unit 4 with respect to the main body frame 34, it is possible to stably hold the detachable unit 4 to the main body frame 34. Further, at the time of detaching of the detachable unit 4, merely by turning the lever member 26, the lock pins 29 are guided by the first inclined portions 51*b* to slip out of the second recesses 51. With this, locking between the detachable unit 4 and the main body frame 34 is canceled, and thus it is possible to easily detach the detachable unit 4 from the main body frame 34.

In addition, the guide shaft 28 provided in the detachable unit 4 is engaged with the third recesses 54 of the movable blade frame 33, and hence it is possible to stably hold the detachable unit 4 to the main body unit 3. Specifically, when the movable blade frame 33 is biased toward the separated position by the biasing means 47, positioning between the detachable unit 4 and the movable blade frame 33 is reliably performed as described above. Thus, it is possible to arrange the movable blade 32 with respect to the fixed blade 11 at an appropriate position. That is, the movable blade 32 can be held in press-contact with the fixed blade 11 at a moderate contact pressure. Thus, it is possible to perform stable cutting operation by the both blades 32 and 11, and to improve cutting accuracy.

As described above, according to the thermal printer 1 of this embodiment, even when there arises a problem that the movable blade 32 is stopped during sliding due to paper jam or the like, it is possible to easily restore the movable blade 32 to the state before the problem arises. Further, positioning between the movable blade frame 33 and the detachable unit 4 is reliably performed, and it is possible to improve printing accuracy and cutting accuracy.

(Second Embodiment)

Figure 12:
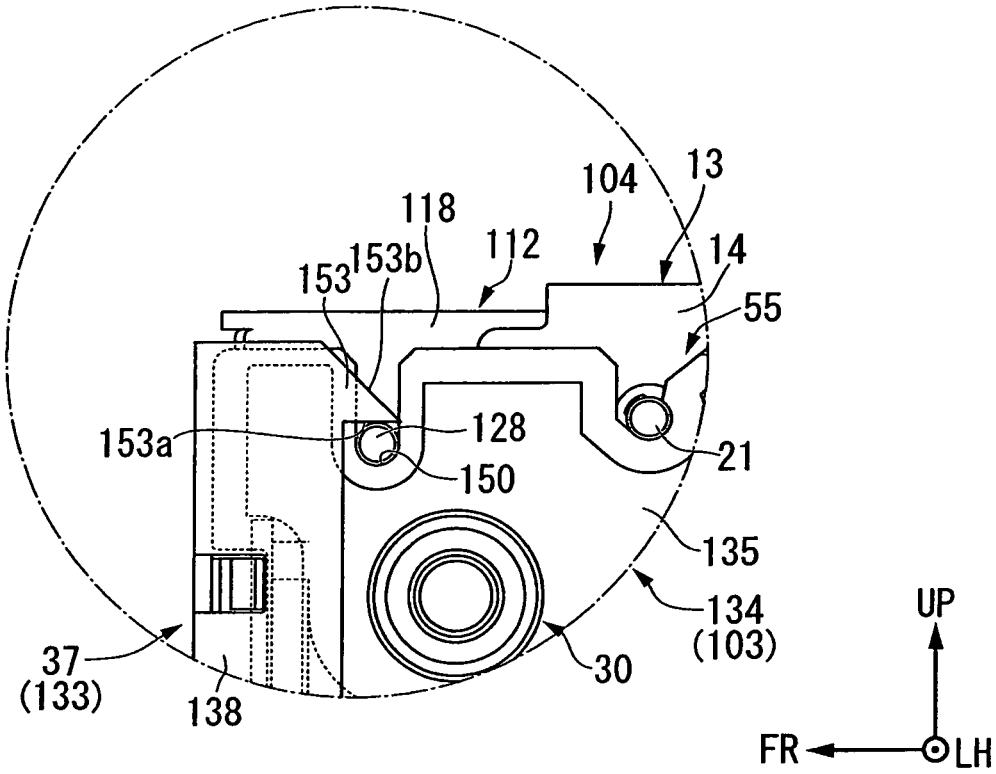
FIG. 12 is an enlarged side view corresponding to the part A of FIG. 3, illustrating operations in a second embodiment.

Next, a second embodiment of the present invention is described with reference to FIGS. 12 and 13. FIG. 12 is an enlarged side view corresponding to the part A of FIG. 3 in the second embodiment. The second embodiment differs from the above-mentioned first embodiment in that a movable blade frame is biased toward the home position, and in a configuration of a ratchet mechanism constituted by a detachable unit and a main body unit. Note that, in the following description, the same components as those in the first embodiment are denoted by the same reference symbols.

As illustrated in FIG. 12, a pair of engagement pins 128 is formed on front portions of both side surfaces 118 of a fixed blade frame 112 of a detachable unit 104 of this embodiment. The engagement pins 128 protrude from the both side surfaces 118 in the lateral directions in the front of the auxiliary shaft 21.

Meanwhile, a pair of recesses 150 is formed in upper peripheral edges of both side plates 135 of a main body frame 134 of a main body unit 103. The recesses 150 receive the above-mentioned engagement pins 128 at the time of mounting of the detachable unit 104, and are formed by cutting the both side plates 135 from the upper peripheral edges thereof downward.

Here, a pair of hook portions 153 having a triangular shape in plan view and extending rearward is formed at upper rear end edges of both side walls 138 of a movable blade frame 133. In the recesses 150, the hook portions 153 are engaged with the engagement pins 128 received in the recesses 150. Each of the hook portions 153 includes a stopper portion 153*a* formed on its lower edge side and extending horizontally in the longitudinal direction, and a guide portion 153*b* formed on its upper edge side and inclined upward and forward. That is, when pulling the engagement pins 128 upward from the recesses 150, the peripheral edges of the stopper portions 153*a* and the outer peripheral surfaces of the engagement pins 128 come into contact with each other, to thereby prevent the engagement pins 128 from slipping out of the recesses 150.

Further, the movable blade frame 133 is provided with a manipulating lever (not shown). Through manipulating the manipulating lever, the movable blade frame 133 is turned from the home position to the separated position. Further, between the movable blade frame 133 and the main body frame 134, there is provided a biasing means such as a coil spring for biasing the movable blade frame 133 to the home position, that is, for biasing the same in a direction in which the movable blade frame 133 is brought close to the main body frame 134. Then, the engagement pins 128, the recesses 150, and the hook portions 153 constitute a ratchet mechanism of this embodiment.

As described above, in a state in which the movable blade frame 133 is biased toward the home position, the engagement pins 128 provided to the detachable unit 104 are engaged with the recesses 150 and the hook portions 153 while being sandwiched therebetween. Thus, after positioning of the main body unit 103 with respect to the detachable unit 104 is reliably performed, it is possible to stably hold the detachable unit 104 to the main body unit 103.

(Clearing Method for Paper Jam)

Figure 13A:
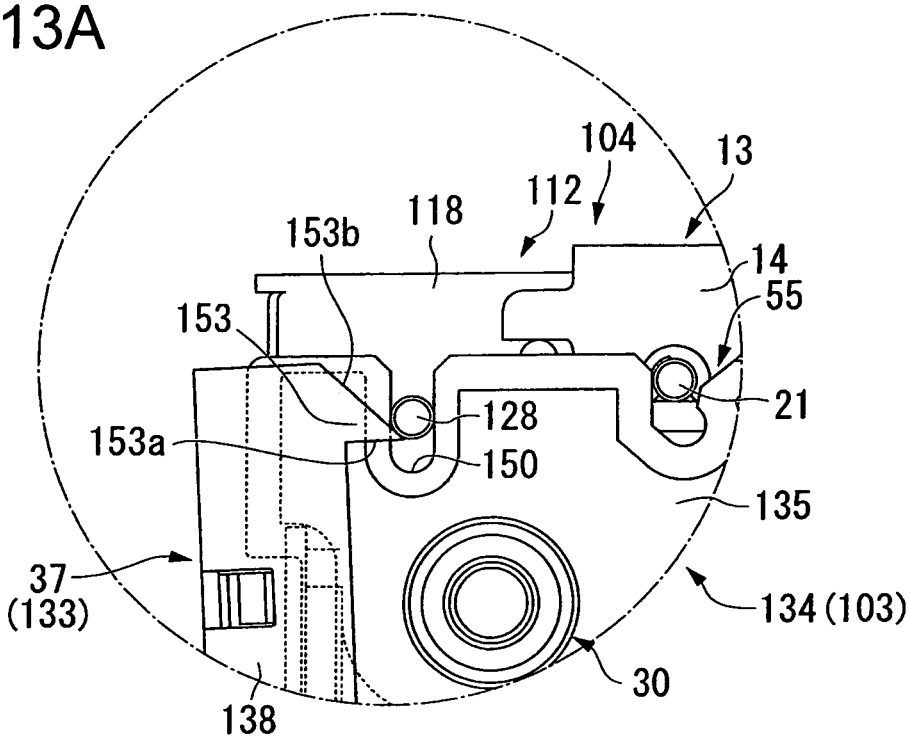
FIG. 13 are enlarged side views corresponding to the part A of FIG. 3, illustrating the operations in the second embodiment.
Figure 13B:
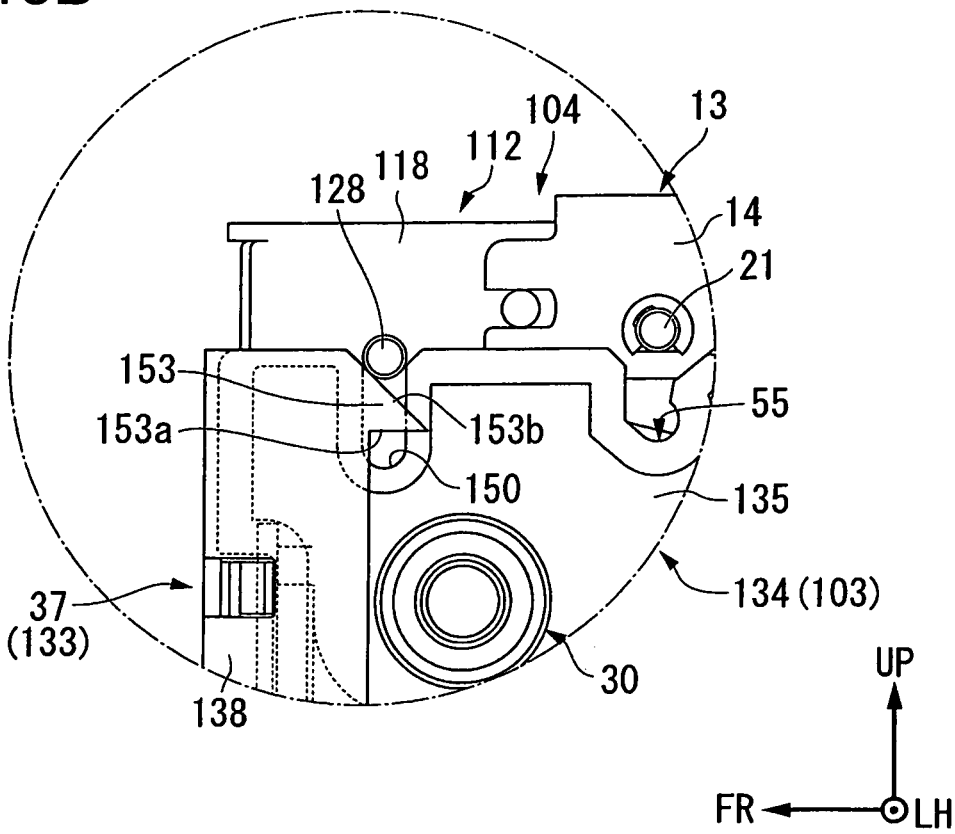

Next, a clearing method for a paper jam according to this embodiment is described. FIGS. 13A and 13B are explanatory views illustrating the operations in the second embodiment.

In this embodiment, as illustrated in FIG. 13A, when the movable blade 32 is stopped halfway due to a paper jam, the manipulating lever is first manipulated, and the movable blade frame 133 is pulled down forward, that is, turned in a direction orthogonal to the sliding direction of the movable blade 32. Then, the stopper portions 153*a* of the hook portions 153 retreat forward, and thus engagement between the stopper portions 153*a* and the engagement pins 128 is released. In this case, the thermal head 10 (see FIG. 1) is pressed against the platen roller 30 by the biasing means 22 at a predetermined head pressure, and hence, owing to a reaction force of this head pressure, the detachable unit 104 is lifted upward, that it, lifted up along the sliding direction of the movable blade 32. Then, when the detachable unit 104 is lifted upward, the engagement pins 128 are lifted upward in the recesses 150, and pass over boundaries between the stopper portions 153*a* and the guide portions 153*b*.

In this case, the movable blade frame 133 moves to the separated position furthest to the main body frame 134, and meshing between the rack 41 of the movable blade holder 40 (see FIG. 6) and the third gear 44*c* (see FIG. 6) is released. With this, the movable blade 32 is biased by the biasing means, and retreats to the initial position in the movable blade frame 133.

Thereafter, when the manipulating lever is restored, the movable blade frame 133 is restored to the home position owing to a biasing force of the biasing means. In this case, the engagement pins 128, which has passed over the boundaries between the stopper portions 153*a* and the guide portions 153*b*, slide over the guide portions 153*b* of the hook portions 153 to be lifted upward. That is, the biasing force to restore the movable blade frame 133 to the home position acts on the engagement pins 128 through the guide portions 153*b*. As a result, the guide portions 153*b* lift up the engagement pins 128 so as to push out the same as the movable blade frame 133 is restored. With this, the ratchet mechanism is released by lifting up the engagement pins 128 to the upper end portions of the guide portions 153*b*, and locking between the detachable unit 104 and the main body unit 103 is canceled. Then, by opening the open-close door 6 (see FIG. 1), the detachable unit 104 is separated from the main body unit 103 with a large space therebetween. Thus, it is possible to remove the recording sheet P caught between the movable blade 32 and the fixed blade 11.

As described above, also in this embodiment, similarly to the first embodiment, at the time of detachably mounting operation of the detachable unit 104, the detachable unit 104 turns along the sliding direction of the movable blade 32, whereas the movable blade frame 133 turns in a direction orthogonal to the sliding direction of the movable blade 32. With this, the movable blade 32 and the fixed blade 11 retreat in directions orthogonal to each other, respectively, and hence the both blades 32 and 11 do not interfere with each other due to contact therebetween at the time of retreating. Thus, it is possible to release bite between the both blades 32 and 11 by releasing the contact pressure between the both blades 32 and 11. Further, it is possible to release meshing between the rack 41 of the movable blade holder 40 and the third gear 44*c*.

In particular, in this embodiment, by biasing the movable blade frame 133 toward the home position, the engagement pins 128 which have passed over the stopper portions 153*a* of the hook portions 153 are automatically lifted up along the guide portions 153*b*. With this, locking of the ratchet mechanism is canceled with a configuration simpler than that of the above-mentioned first embodiment, and bite between the both blades 32 and 11 can be released. Further, when the movable blade frame 133 is at the home position, it is possible to stably hold the movable blade frame 133 with respect to the main body frame 134 without backlash.

Note that, in the above-mentioned embodiment, there is described a case where the manipulating lever is provided to the movable blade frame 133. However, there may be adopted a configuration in which the manipulating lever is provided to the fixed blade frame 112 side and the movable blade frame 133 is turned in a direction orthogonal to the sliding direction of the movable blade 32 in conjunction with manipulation of the manipulating lever.

(Third Embodiment)

Figure 14:
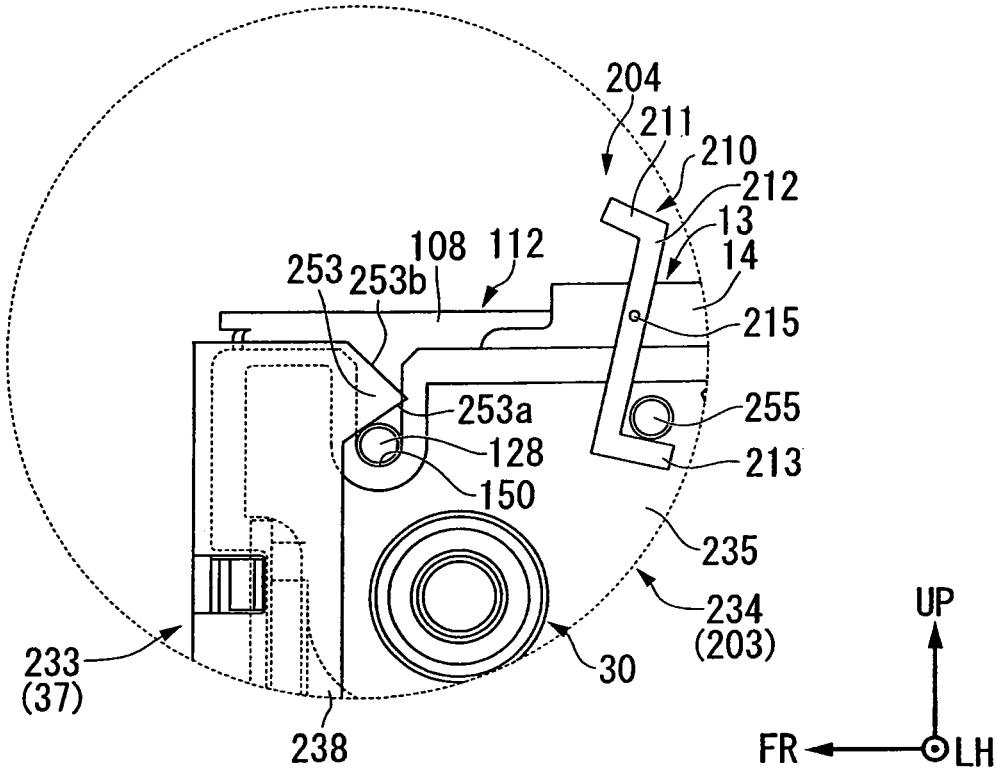
FIG. 14 is an enlarged side view corresponding to the part A of FIG. 3, illustrating operations in a third embodiment.

Next, a third embodiment of the present invention is described with reference to FIGS. 14 and 15. FIG. 14 is an enlarged side view corresponding to the part A of FIG. 3 in the third embodiment. The third embodiment differs from the above-mentioned second embodiment in a configuration of a ratchet mechanism constituted by a detachable unit and a main body unit. Note that, in the following description, the same components as those in each of the first and second embodiments are denoted by the same reference symbols.

As illustrated in FIG. 14, a pair of engagement pins 255 is formed on upper portions of both side plates 235 of a main body frame 234 of a main body unit 203. The engagement pins 255 protrude in the lateral directions from the upper peripheral edges at the center portions in the longitudinal direction of the side plates 235.

Further, a pair of hook portions 253 having a triangular shape in plan view and extending rearward is formed at upper rear end edges of both side walls 238 of a movable blade frame 233. The hook portions 253 are engaged in the recesses 150 with the engagement pins 128 received in the recesses 150, and formed to be gradually narrowed rearward. That is, the hook portions 253 are engaged in the recesses 150 with the engagement pins 128 received in the recesses 150, and each of the hook portions 253 includes a first inclined portion 253*a* formed at its lower peripheral edge to be inclined rearward and upward, and a second inclined portion 253*b* formed at its upper peripheral edge to be inclined rearward and downward. That is, when a detachable unit 104 is at the mounted position, the engagement pins 128 are engaged between the first inclined portions 253*a* and the recesses 150. Note that, similarly to the second embodiment, between the movable blade frame 233 and the main body frame 234, there is provided a biasing means such as a coil spring for biasing the movable blade frame 233 to the home position, that is, for biasing the same in a direction in which the movable blade frame 233 is brought close to the main body frame 234.

Here, a lever member 210 capable of turning with respect to the frame 13 is provided to the frame 13 of the detachable unit 204. The lever member 210 mainly includes a manipulating portion 211, extending portions 212, and engagement portions 213.

The manipulating portion 211 is a plate-shaped member extending in the lateral direction of the frame 13, and is arranged while being inclined forward and upward. A pair of the extending portions 212 extending downward is formed at the both ends of the manipulating portion 211. A turning pin 215 is inserted through the extending portions 212 from the center portion in the longitudinal direction (vertical direction) of each of the extending portions 212 to the thickness direction (lateral direction) thereof. The turning pin 215 couples the lever member 210 and the side surfaces 14 of the frame 13 to each other so as to turnably support the lever member 210. Through manipulating the manipulating portion 211, the lever member 210 can turn about the turning pin 215 along the conveying direction of the recording sheet P.

Further, the engagement portions 213 bent rearward from the extending portions 212 by approximately 90 degrees are formed at the lower ends of the extending portions 212, respectively. When the detachable unit 204 is at the mounted position, the engagement portions 213 are engaged with the above-mentioned engagement pins 255, to thereby lock the detachable unit 204 and the main body unit 203 with each other. Note that, a biasing means (not shown) is provided to the lever member 210, and biases the engagement portions 213 rearward. Further, the lever member 210 and the engagement pins 255, and the hook portions 253 and the engagement pins 128 constitute a ratchet mechanism of this embodiment.

(Clearing Method for Paper Jam)

Figure 15A:
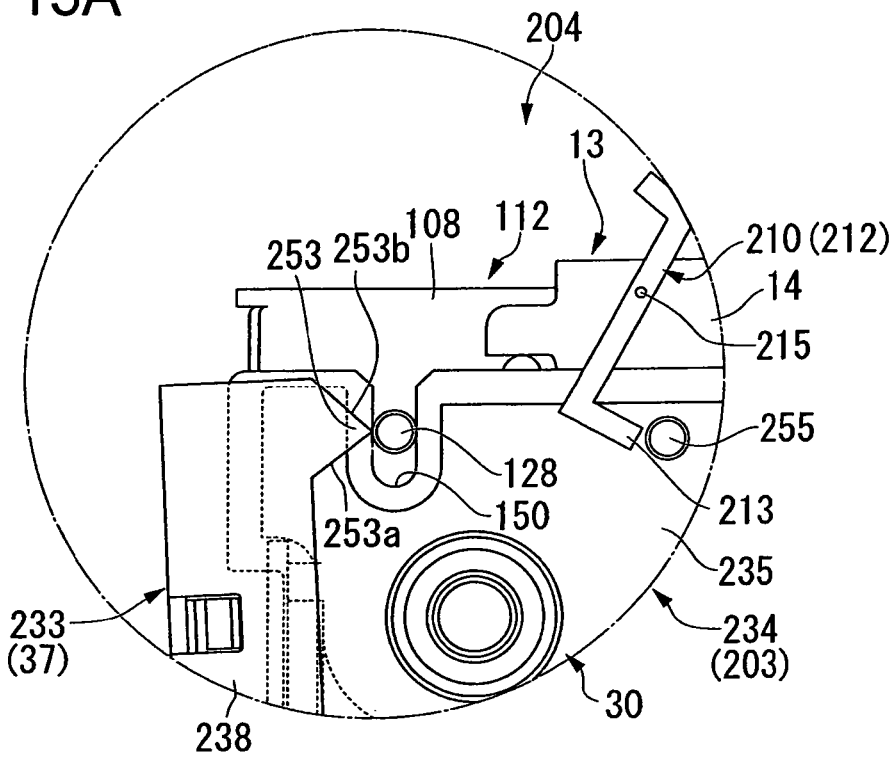
FIG. 15 are enlarged side views corresponding to the part A of FIG. 3, illustrating the operations in the third embodiment.
Figure 15B:
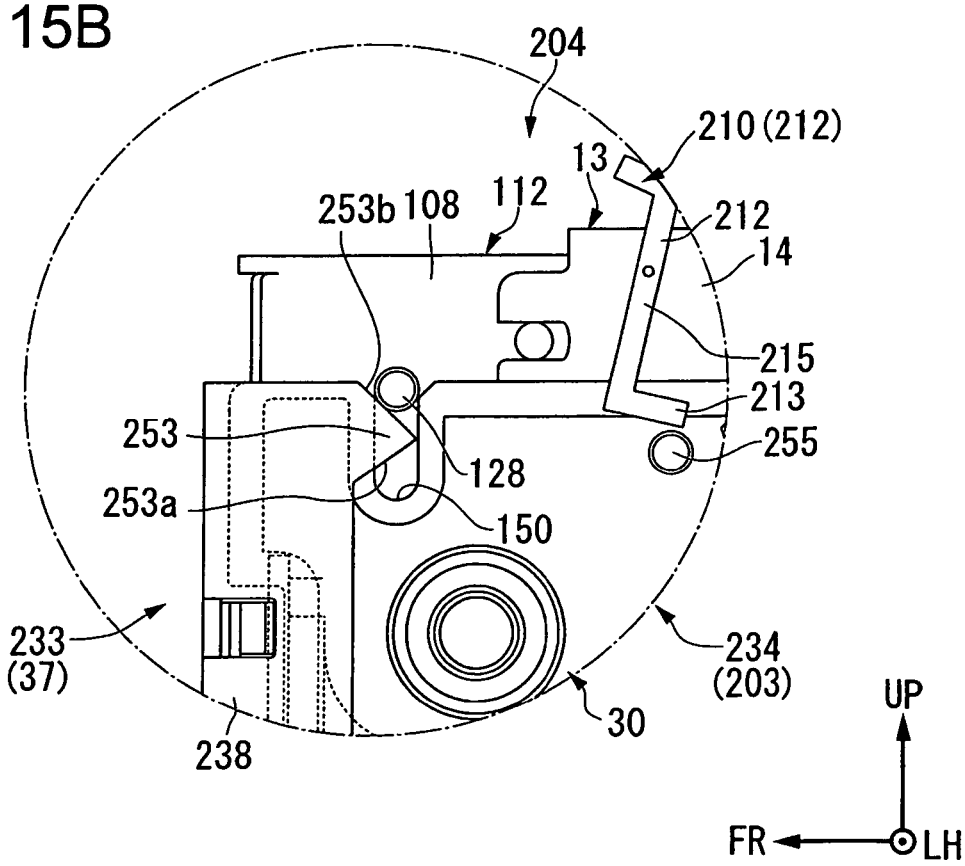

Next, a clearing method for a paper jam according to this embodiment is described. FIGS. 15A-15B are explanatory views illustrating the operations in the third embodiment.

In this embodiment, as illustrated in FIG. 15A, when the movable blade 32 is stopped halfway due to paper jam, the manipulating portion 211 of the lever member 210 is first pulled down, and engagement between the engagement portions 213 and the engagement pins 255 is released. Further, when the manipulating portion 211 is lifted upward in a state in which the lever member 210 is pulled down, the detachable unit 204 turns, and the engagement pins 128 lift upward while sliding on the first inclined portions 253*a* of the hook portions 253. Then, the movable blade frame 233 turns so as to be pushed down forward by the engagement pins 128. Accordingly, the movable blade frame 233 moves to the separated position furthest to the main body frame 234, and meshing between the rack 41 of the movable blade holder 40 (see FIG. 6) and the third gear 44*c* (see FIG. 6) is released. With this, the movable blade 32 is biased by the biasing means, and retreats to the initial position in the movable blade frame 233.

Further, when the detachable unit 204 passes over boundaries between the first inclined portions 253*a* and the second inclined portions 253*b*, the movable blade frame 233 is restored to the home position owing to a biasing force of the biasing means. In this case, the engagement pins 128 slide over the second inclined portions 253*b* of the hook portions 253 to be lifted upward. That is, as illustrated in FIG. 15B, the biasing force to restore the movable blade frame 233 to the home position acts on the engagement pins 128 through the second inclined portions 253*b*. As a result, the second inclined portions 253*b* lift up the engagement pins 128 so as to push out the same as the movable blade frame 233 is restored. With this, the ratchet mechanism is released by lifting up the engagement pins 128 to the upper end portions of the second inclined portions 253*b*, the contact pressure between the both blades 32 and 11 is released, and locking between the detachable unit 204 and the main body unit 203 is canceled. Further, by lifting the manipulating portion 211 upward in this state, the open-close door 6 (see FIG. 1) is opened, and the detachable unit 204 is separated from the main body unit 203 with a large space therebetween. Thus, it is possible to remove the recording sheet P caught between the movable blade 32 and the fixed blade 11.

As described above, in this embodiment, it is possible to obtain the same effects as those in second embodiment. In addition, the manipulating portion 211 is provided to the detachable unit 204 side. Therefore, by lifting the manipulating portion 211 upward while being pulled down, it is possible to simultaneously perform separating operation of the both blades 32 and 11 from each other, releasing operation of the ratchet mechanism, and opening operation of the open-close door 6. That is, those operations can be performed in one-time operation, and hence it is possible to improve operativity, and to alleviate a burden on a user.

It is noted that the technical scope of the present invention is not limited to the above-mentioned embodiments. Various modifications are possible without departing from the gist of the present invention.

For example, in each of the embodiments, the thermal printer 1 is described as the example of the printer with a cutter. However, the present invention is not limited to the thermal printer 1. For example, there maybe adopted an ink jet printer having a configuration in which the print head is an ink jet head and printing is performed on the drawn-out recording sheet P with use of ink droplets. Further, in each of the embodiments, there is exemplified the drop-in thermal printer in which the paper roll R is dropped to be merely placed on the placing base 2*b*. However, other than this drop-in thermal printer, there may be adopted a thermal printer of a shaft-supporting type including a shaft-supporting mechanism for rotatably supporting the paper roll R inside the casing 2.

Figure 16:
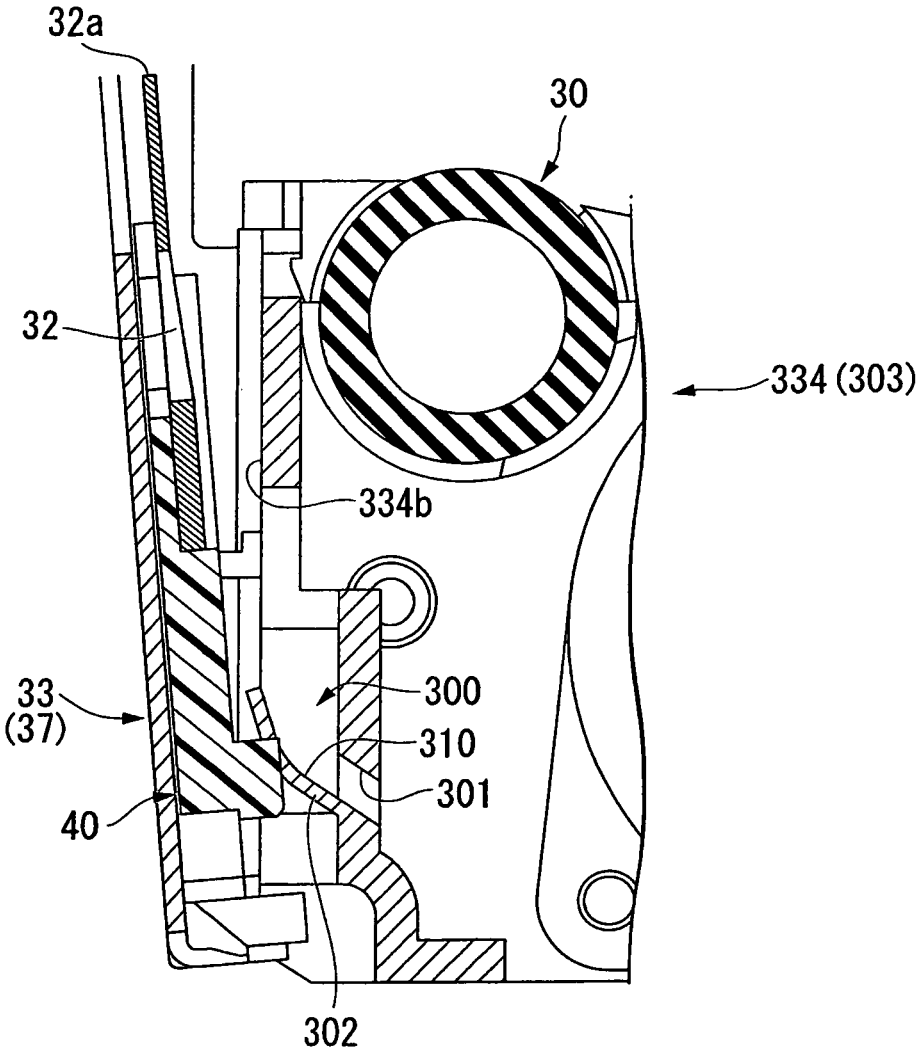
FIG. 16 is an enlarged sectional view of a main body unit according to another configuration of the present invention.

FIG. 16 is a sectional view of a main body unit according to another configuration of the present invention. Note that, in the following description, the same components as those in the first embodiment are denoted by the same reference symbols, and description thereof is omitted.

As illustrated in FIG. 16, a paper powder chute 300 is provided along the lateral direction between a main body frame 334 of a main body unit 303 and the movable blade frame 33. Specifically, the paper powder chute 300 has, in a lower portion of a front surface 334*b* of the main body frame 334 (surface opposed to front wall 37 of movable blade frame 33), a through hole 301 formed therein to pass through the front surface 334*b* in its thickness direction. The through hole 301 is inclined downward toward the rear thereof, and has one end opened to the front surface 334*b* of the main body frame 334 and the other end opened to a space formed in the lower portion of the main body frame 334. That is, the through hole 301 functions as a discharge port for the paper powder scattering or accumulating between the movable blade frame 33 and the main body frame 334.

Further, at the inner peripheral edge on the one end side of the through hole 301, there is formed a guide plate 302 extending forward from the front surface 334*b* of the main body frame 334. The guide plate 302 is a plate-shaped member inclined upward toward the front thereof, and guides to the through hole 301 the paper powder scattering or accumulating between the movable blade frame 33 and the main body frame 334. Note that, the guide plate 302 extends so as not to interfere with the movable blade 32 and the movable blade holder 40.

Further, between the guide plate 302 and the front surface 334*b* of the main body frame 334, there is formed a paper powder receiving portion (paper powder accumulating portion) 310 opened upward. The paper powder receiving portion 310 receives the paper powder guided by the guide plate 302, and the received paper powder is discharged through the through hole 301.

As described above, the paper powder chute 300 is provided between the main body frame 334 and the movable blade frame 33, and hence the paper powder, which is generated when the recording sheet P is cut, is guided by the guide plate 302 to be received in the paper powder receiving portion 310 when falling downward due to impact or the like at the time of cutting operation and open-close operation of the movable blade frame 33. Then, the paper powder received in the paper powder receiving portion 310 passes through the through hole 301 to be discharged into the space formed in the lower portion of the main body frame 334. Therefore, the paper powder does not accumulate between the movable blade frame 33 and the main body frame 334, and hence it is possible to improve ease of maintenance. In addition, there is no fear that the paper powder adheres to a rail (not shown) for sliding the movable blade holder 40, the rack 41, and the like and operation for the movable blade holder 40 or the rack 41 is inhibited. Further, there is no fear that the paper powder adheres to the movable blade 32 and cutting accuracy in the recording sheet P is decreased. Therefore, it is possible to perform stable cutting operation by the both blades 32 and 11.

It is noted that in each of the first to third embodiments, there is described the configuration in which the platen roller is provided to the main body unit side and the thermal head is provided to the detachable unit side. However, there may be adopted a configuration in which the thermal head is provided to the main body unit side and the platen roller is provided to the detachable unit side.

Further, design modifications can be appropriately made on the turning amount of the movable blade frame from the home position to the separated position. For example, by securing a large turning amount of the movable blade frame, a large open space is formed between the main body frame and the movable blade frame when the movable blade frame is at the separated position. Thus, it becomes easy to perform work in the movable blade frame at the time of maintenance and the like.

What is claimed is:

1. A printer with a cutter for cutting a recording sheet after printing is performed on the recording sheet, comprising:

a print head that performs printing on a recording sheet during a printing operation;

a platen roller that supports the recording sheet adjacent to the print head during a printing operation;

a main body frame that supports one of the print head and the platen roller;

a cutter having a fixed blade and a movable blade that is mounted to undergo sliding movement toward the fixed blade for cutting the recording sheet after printing is performed on the recording sheet;

a movable blade frame slidingly supporting the movable blade of the cutter, the movable blade frame being mounted to undergo movement in a direction generally orthogonal to a sliding direction of the movable blade from a home position, at which the movable blade frame is incorporated into the main body frame, to a separated position, at which the movable blade frame is separated from the main body frame;

a main body unit mounting the movable blade frame to the main body frame; and a detachable unit incorporating the fixed blade and supporting the other of the print head and the platen roller, the detachable unit being detachably mounted on the main body unit for undergoing movement in the sliding direction of the movable blade from a mounted position, at which the detachable unit is mounted to the main body unit, to a dismounted position, at which the detachable unit is detached from the main body unit, wherein the detachable unit comprises a lever member configured to undergo turning movement about a shaft, the lever member comprising a lock pin protruding in a width direction of the fixed blade;

the main body frame has a first recess for receiving the shaft in a state in which the detachable unit is at the mounted position, and a second recess for receiving the lock pin in the state in which the detachable unit is at the mounted position;

a first regulating portion is formed at an inner peripheral edge of the first recess for regulating movement of the shaft in the state in which the detachable unit is at the mounted position; and a second regulating portion is formed at an inner peripheral edge of the second recess for regulating movement of the lock pin in the state in which the detachable unit is at the mounted position, the second regulating portion being formed such that the lock pin is capable of slipping out of the second recess when the lever member turns about the shaft.

2. A printer with a cutter according to claim 1; further comprising:

a rack integral with the movable blade;

drive means disposed in the main body frame for sliding the movable blade; and a gear train mechanism for transmitting a drive force from the drive means to the: rack, wherein the gear train mechanism and the rack mesh with each other at the home position of the movable blade frame; and meshing between the gear train mechanism and the rack is released at the separated position of the movable blade frame.

3. A printer with a cutter according to claim 2; further comprising biasing means disposed between the movable blade and the movable blade frame for biasing the movable blade in a direction of separating the movable blade from the fixed blade.

4. A printer with a cutter according to claim 1; further comprising biasing means disposed between the movable blade frame and the main body frame for biasing the movable blade frame to the separated position.

5. A printer with a cutter according to claim 1; wherein the main body unit is incorporated into a casing having an opening from which the recording sheet is received; and a stopper is formed in the casing for preventing the movable blade from protruding from the movable blade frame at the separated position of the movable blade frame.

6. A printer with a cutter according to claim 1; wherein the movable blade frame has a third recess engageable with the shaft together with the first recess of the main body frame in a state in which the movable blade frame is at the home position; and a guide portion is formed at an inner peripheral edge of the third recess for guiding the shaft such that the movable blade frame moves to the home position when the detachable unit moves to the mounted position, and for guiding the shaft such that the detachable unit moves to the dismounted position when the movable blade frame moves to the separated position.

7. A printer with a cutter for cutting a recording sheet after printing is performed on the recording sheet, comprising:

a print head that performs printing on a recording sheet during a printing operation;

a platen roller that supports the recording sheet adjacent to the print head during a printing operation;

a main body frame that supports one of the print head and the platen roller;

a cutter having a fixed blade and a movable blade that is mounted to undergo sliding movement toward the fixed blade for cutting the recording sheet after printing is performed on the recording sheet;

a movable blade frame slidingly supporting the movable blade of the cutter, the movable blade frame being mounted to undergo movement in a direction generally orthogonal to a sliding direction of the movable blade from a home position, at which the movable blade frame is incorporated into the main body frame, to a separated position, at which the movable blade frame is separated from the main body frame;

a main body unit mounting the movable blade frame to the main body frame;

a detachable unit incorporating the fixed blade and supporting the other of the print head and the platen roller, the detachable unit being detachably mounted on the main body unit for undergoing movement in the sliding direction of the movable blade from a mounted position, at which the detachable unit is mounted to the main body unit, to a dismounted position, at which the detachable unit is detached from the main body unit, and biasing means disposed between the movable blade frame and the main body frame for biasing the movable blade frame to the home position, wherein the detachable unit comprises an engagement pin protruding in a width direction of the fixed blade;

the main body frame comprises a recess for receiving the engagement pin in a state in which the detachable unit is at the mounted position; and the movable blade frame comprises a hook portion for engagement in the recess with the engagement pin in a state in which the movable blade frame is at the home position.

8. A printer with a cutter according to claim 7; further comprising a paper powder accumulating portion provided between the movable blade frame and the main body frame for collecting paper powder generated when the recording sheet is cut.

9. A printing device comprising:

a print head for performing printing on a sheet material;

a platen roller for supporting the sheet material adjacent to the print head;

a sheet cutting device having first and second blades for cutting the sheet material on which printing has been performed, the first blade being mounted to undergo sliding movement relative to the second blade in a direction substantially orthogonal to a surface of the sheet material for cutting the sheet material;

a main body frame supporting one of the print head and the platen roller;

a first blade frame slidably supporting the first blade, the first blade frame being mounted to undergo movement in a direction generally orthogonal to a sliding direction of the first blade from a first position at which the first blade frame is incorporated to the main body frame to a second position at which the first blade frame is separated from the main body frame;

a main body unit incorporating the main body frame;

a second blade frame supporting the second blade, the second blade frame being mounted to undergo movement in the sliding direction of the first blade from a first position at which the second blade frame is mounted to the main body unit to a second position at which the second blade frame is detached from the main body unit, the first and second blades undergoing movement in directions orthogonal to each other during movement of the first and second blade frames to the second positions to release a contact pressure between the first and second blades;

a lever member mounted to the second blade frame for undergoing pivotal movement about a shaft, the lever member having a lock pin protruding in a width direction of the second blade;

a first recess formed in the main body frame for receiving the shaft in a state in which the second blade frame is at the first position;

a second recess formed in the main body frame for receiving the lock pin in a state in which the second blade frame is at the first position;

a first regulating portion formed at an inner peripheral edge of the first recess for regulating movement of the shaft in the state in which the second blade frame is at the first position; and a second regulating portion formed at an inner peripheral edge of the second recess for regulating movement of the lock pin in the state in which the second blade frame is at the first position.

10. A printing device according to claim 9; further comprising biasing means for biasing the first blade in a direction of separating the first blade from the second blade.

11. A printing device according to claim 9; further comprising biasing means for biasing the first blade frame to the second position.

12. A printing device according to claim 9; further comprising a third recess formed in the main body frame for engagement with the shaft in the state in which the first blade frame is at the first position.

13. A printing device according to claim 12; further comprising a guide portion formed at an inner peripheral edge of the third recess for guiding the shaft such that the first blade frame moves to the first position when the second blade frame moves to the first position and for guiding the shaft such that the second blade frame moves to the second position when the first blade frame moves to the second position.

14. A printing device according to claim 9; further comprising a paper powder receiving portion disposed between the first blade frame and the main body frame for receiving paper powder generated when the sheet material is cut by the first and second blades.

15. A printing device comprising:

a print head for performing printing on a sheet material;

a platen roller for supporting the sheet material adjacent to the print head;

a sheet cutting device having first and second blades for cutting the sheet material on which printing has been performed, the first blade being mounted to undergo sliding movement relative to the second blade in a direction substantially orthogonal to a surface of the sheet material for cutting the sheet material;

a main body frame supporting one of the print head and the platen roller;

a first blade frame slidably supporting the first blade, the first blade frame being mounted to undergo movement in a direction generally orthogonal to a sliding direction of the first blade from a first position at which the first blade frame is incorporated to the main body frame to a second position at which the first blade frame is separated from the main body frame;

a main body unit incorporating the main body frame; and a second blade frame supporting the second blade, the second blade frame being mounted to undergo movement in the sliding direction of the first blade from a first position at which the second blade frame is mounted to the main body unit to a second position at which the second blade frame is detached from the main body unit, the first and second blades undergoing movement in directions orthogonal to each other during movement of the first and second blade frames to the second positions to release a contact pressure between the first and second blades; wherein the second blade frame has an engagement pin protruding in a width direction of the second blade;

the main body frame has a recess for receiving the engagement pin in a state in which the second blade frame is at the first position; and the first blade frame has a hook portion that is received by the recess together with the engagement pin in a state in which the first blade frame is at the first position.

* * * * *